US009816373B2

(12) United States Patent
Howell et al.

(10) Patent No.: US 9,816,373 B2
(45) **Date of Patent: *Nov. 14, 2017**

(54) APPARATUS AND METHOD FOR RELIEVING ANNULAR PRESSURE IN A WELLBORE USING A WIRELESS SENSOR NETWORK

(71) Applicants: David A. Howell, Houston, TX (US); Timothy I. Morrow, Humble, TX (US); Mark M. Disko, Glen Gardner, NJ (US); Max Deffenbaugh, Fulshear, TX (US)

(72) Inventors: David A. Howell, Houston, TX (US); Timothy I. Morrow, Humble, TX (US); Mark M. Disko, Glen Gardner, NJ (US); Max Deffenbaugh, Fulshear, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 143 days.

This patent is subject to a terminal disclaimer.

(21) Appl. No.: 14/432,970

(22) PCT Filed: Dec. 18, 2013

(86) PCT No.: PCT/US2013/076275

§ 371 (c)(1),
(2) Date: Apr. 1, 2015

(87) PCT Pub. No.: WO2014/100266

PCT Pub. Date: Jun. 26, 2014

(65) Prior Publication Data

US 2015/0285065 A1 Oct. 8, 2015

Related U.S. Application Data

(60) Provisional application No. 61/739,681, filed on Dec. 19, 2012.

(51) Int. Cl.
*E21B 47/16* (2006.01)
*E21B 47/00* (2012.01)
*E21B 47/01* (2012.01)

(52) U.S. Cl.
CPC ..... *E21B 47/16* (2013.01); *E21B 47/0005* (2013.01); *E21B 47/011* (2013.01)

(58) Field of Classification Search
None
See application file for complete search history.

(56) References Cited

U.S. PATENT DOCUMENTS 4,314,365 A 2/1982 Peterson et al.
4,884,071 A 11/1989 Howard
(Continued)

FOREIGN PATENT DOCUMENTS

EP 0 636 763 A2 2/1995
EP 1 409 839 B1 4/2005
(Continued)

OTHER PUBLICATIONS

Emerson Process Management (2011), "Roxar downhole Wireless PT sensor system," www roxar.com, or downhole@roxar.com, 2 pgs.

*Primary Examiner* — Laura Nguyen
(74) *Attorney, Agent, or Firm* — ExxonMobil Upstream Research Company—Law Department

(57) ABSTRACT

An electro-acoustic system for downhole telemetry is provided herein. The system employs a series of communications nodes spaced along a string of casing within a wellbore. The nodes are placed within the annular region surrounding the joints of casing within the well-bore. The nodes allow for wireless communication between transceivers residing within the communications nodes and a topside communications node at the wellhead. More specifically, the transceivers provide for node-to-node communication up a
(Continued)

wellbore at high data transmission rates for data indicative of a parameter within an annular region behind the string of casing. A method of evaluating a parameter within an annular region along a cased-hole wellbore is also provided herein. The method uses a plurality of data transmission nodes situated along the casing string which send signals to a receiver at the surface. The signals are then analyzed.

46 Claims, 8 Drawing Sheets

(56) References Cited

U.S. PATENT DOCUMENTS 5,128,901 A 7/1992 Drumheller
5,234,055 A 8/1993 Cornette
5,480,201 A 1/1996 Mercer
5,495,230 A 2/1996 Lian
5,562,240 A 10/1996 Campbell
5,592,438 A 1/1997 Rorden et al.
5,850,369 A 12/1998 Rorden et al.
5,924,499 A 7/1999 Birchak et al.
5,995,449 A 11/1999 Green et al.
6,049,508 A 4/2000 Deflandre
6,128,250 A * 10/2000 Reid ..... G10K 11/008 367/153
6,429,784 B1 8/2002 Beique et al.
6,462,672 B1 10/2002 Besson
6,670,880 B1 12/2003 Hall et al.
6,695,277 B1 2/2004 Gallis
6,717,501 B2 4/2004 Hall et al.
6,816,082 B1 * 11/2004 Laborde ..... E21B 47/12 340/853.2
6,868,037 B2 3/2005 Dasgupta et al.
6,899,178 B2 5/2005 Tubel
6,912,177 B2 6/2005 Smith
6,956,791 B2 10/2005 Dopf et al.
6,980,929 B2 12/2005 Aronstam et al.
6,987,463 B2 1/2006 Beique et al.
7,006,918 B2 2/2006 Economides et al.
7,064,676 B2 6/2006 Hall et al.
7,082,993 B2 8/2006 Ayoub et al.
7,140,434 B2 11/2006 Chouzenoux et al.
7,224,288 B2 5/2007 Hall et al.
7,249,636 B2 7/2007 Ohmer
7,257,050 B2 8/2007 Stewart et al.
7,277,026 B2 10/2007 Hall et al.
7,317,990 B2 1/2008 Sinha et al.
7,348,893 B2 3/2008 Huang et al.
7,411,517 B2 8/2008 Flanagan
7,477,160 B2 1/2009 Lemenager et al.
7,516,792 B2 4/2009 Lonnes et al.
7,595,737 B2 9/2009 Fink et al.
7,602,668 B2 10/2009 Liang et al.
7,649,473 B2 1/2010 Johnson et al.
7,775,279 B2 8/2010 Marya et al.
8,044,821 B2 10/2011 Mehta
8,049,506 B2 11/2011 Lazarev
8,115,651 B2 2/2012 Camwell et al.
8,162,050 B2 4/2012 Roddy et al.
8,220,542 B2 7/2012 Whitsitt et al.
8,237,585 B2 8/2012 Zimmerman
8,242,928 B2 8/2012 Prammer
8,330,617 B2 12/2012 Chen et al.
8,347,982 B2 1/2013 Hannegan et al.
8,381,822 B2 2/2013 Hales et al.
8,434,354 B2 5/2013 Crow et al.
8,496,055 B2 7/2013 Mootoo et al.
8,539,890 B2 9/2013 Tripp et al.
8,544,564 B2 10/2013 Moore et al.
8,826,980 B2 9/2014 Neer
8,833,469 B2 9/2014 Purkis
2002/0026958 A1 3/2002 Brisco
2002/0043369 A1 * 4/2002 Vinegar ..... E21B 17/003 166/250.07
2003/0056953 A1 3/2003 Tumlin et al.
2004/0065443 A1 4/2004 Berg et al.
2004/0073370 A1 4/2004 Dasgupta et al.
2004/0084190 A1 5/2004 Hill et al.
2004/0105342 A1 6/2004 Gardner et al.
2004/0256113 A1 12/2004 LoGiudice et al.
2005/0024231 A1 2/2005 Fincher et al.
2005/0039912 A1 2/2005 Hall et al.
2005/0145010 A1 7/2005 Vanderveen et al.
2005/0284659 A1 12/2005 Hall et al.
2006/0002232 A1 1/2006 Shah et al.
2006/0115095 A1 6/2006 Giesbrecht et al.
2006/0124310 A1 * 6/2006 Lopez de Cardenas ..... E21B 34/06 166/313
2006/0133203 A1 6/2006 James et al.
2007/0024464 A1 * 2/2007 Lemenager ..... G01V 11/002 340/853.1
2007/0029112 A1 2/2007 Li et al.
2007/0030762 A1 2/2007 Huang et al.
2007/0139217 A1 * 6/2007 Beique ..... E21B 17/14 340/856.3
2008/0314585 A1 * 12/2008 Clark ..... E21B 17/1007 166/250.17
2009/0003133 A1 * 1/2009 Dalton ..... E21B 47/16 367/82
2009/0045974 A1 2/2009 Patel
2009/0154589 A1 * 6/2009 Monnerie ..... H04L 27/0008 375/269
2009/0159272 A1 6/2009 Auzerias et al.
2009/0264956 A1 10/2009 Rise et al.
2009/0277688 A1 11/2009 Oothoudt
2009/0289808 A1 11/2009 Prammer
2010/0013663 A1 1/2010 Cavender et al.
2010/0126718 A1 5/2010 Lilley
2010/0157739 A1 6/2010 Slocum et al.
2010/0176813 A1 7/2010 Simon
2010/0194584 A1 8/2010 Savage
2011/0066378 A1 3/2011 Lerche et al.
2011/0168403 A1 7/2011 Patel
2011/0186290 A1 8/2011 Roddy et al.
2011/0192597 A1 * 8/2011 Roddy ..... E21B 33/13 166/253.1
2011/0275313 A1 11/2011 Baldemair et al.
2011/0280294 A1 11/2011 Luo et al.
2011/0297376 A1 12/2011 Holderman et al.
2012/0017673 A1 1/2012 Godager
2012/0024050 A1 2/2012 Godagar
2012/0024052 A1 2/2012 Eriksen
2012/0043079 A1 2/2012 Wassouf et al.
2012/0090687 A1 4/2012 Grigsby et al.
2012/0170410 A1 7/2012 Hay
2012/0241172 A1 9/2012 Ludwig et al.
2012/0250461 A1 * 10/2012 Millot ..... H04B 11/00 367/82
2012/0256415 A1 * 10/2012 Dole ..... F16L 17/04 285/337
2012/0256492 A1 10/2012 Song et al.
2012/0257475 A1 10/2012 Luscombe et al.
2013/0008648 A1 1/2013 Lovorn et al.
2013/0106615 A1 5/2013 Prammer
2013/0110402 A1 5/2013 Godager
2013/0175094 A1 7/2013 Ross et al.
2013/0248172 A1 9/2013 Angeles Boza et al.
2013/0248174 A1 9/2013 Dale et al.
2014/0152659 A1 6/2014 Davidson et al.
2014/0266769 A1 9/2014 van Zelm
2014/0327552 A1 11/2014 Filas et al.
2014/0352955 A1 12/2014 Tubel et al.
2015/0003202 A1 1/2015 Palmer et al.
2015/0009040 A1 1/2015 Bowles et al.
2015/0027687 A1 1/2015 Tubel

FOREIGN PATENT DOCUMENTS

WO 2010/074766 A1 7/2010
WO 2013/079928 A2 6/2013
WO 2013/079929 A2 6/2013

(56) References Cited

FOREIGN PATENT DOCUMENTS

| | | | |
|---|---|---|---|
| WO | WO 2013/112273 | A2 | 8/2013 |
| WO | WO 2014/018010 | A1 | 1/2014 |
| WO | WO 2014/049360 | A2 | 4/2014 |
| WO | WO 2014/134741 | A1 | 9/2014 |

* cited by examiner

APPARATUS AND METHOD FOR RELIEVING ANNULAR PRESSURE IN A WELLBORE USING A WIRELESS SENSOR NETWORK

STATEMENT OF RELATED APPLICATIONS

This application is the National Stage of International Application No. PCT/US13/076275, filed Dec. 18, 2013, which claims the benefit of U.S. Provisional Application No. 61/739,681, filed Dec. 19, 2012 and is incorporated herein in its entirety.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present invention relates to the field of well drilling and completions. More specifically, the invention relates to the transmission of data along a tubular body within a wellbore. The present invention further relates to the monitoring of annular conditions behind a casing string using sensors and acoustic signals.

General Discussion of Technology

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. An annular area is thus formed between the string of casing and the formation penetrated by the wellbore.

A cementing operation is typically conducted in order to fill or "squeeze" part or all of the annular area with a column of cement. The combination of cement and casing strengthens the wellbore and facilitates the zonal isolation of certain sections of a hydrocarbon-producing formation (or "pay zones") behind the casing.

In most drilling operations, a first string of casing is placed from the surface and down to a first drilled depth. This casing is known as surface casing. In the case of offshore operations, this casing may be referred to as a conductor pipe. One of the main functions of the initial string of casing is to isolate and protect the shallower, fresh water bearing aquifers from contamination by wellbore fluids. Accordingly, this casing string is almost always cemented entirely back to the surface.

One or more intermediate strings of casing is also run into the wellbore. These casing strings will have progressively smaller outer diameters. Each successive pipe string extends to a greater depth than its predecessor, and has a smaller diameter than its predecessor.

The process of drilling and then cementing progressively smaller strings of casing is repeated several times until the well has reached total depth. A final string of casing, referred to as production casing, is used along the pay zones. In some instances, the final string of casing is a liner, that is, a pipe string that is hung in the wellbore using a liner hanger. The final string of casing is also typically cemented into place.

Additional tubular bodies may be included in a well completion. These include one or more strings of production tubing placed within the production casing or liner. Each tubing string extends from the surface to a designated depth proximate a production interval, or "pay zone." Each tubing string may be attached to a packer. The packer serves to seal off the annular space between the production tubing string(s) and the surrounding casing. The production tubing provides a conduit through which hydrocarbons or other formation fluids may flow to the surface for recovery.

In most current wellbore completion jobs, especially those involving so called unconventional formations where high-pressure hydraulic operations are conducted downhole, the casing strings are entirely cemented in place. Hydraulic cements, usually Portland cement, are typically used to cement the tubular bodies within the wellbore. During completion, it is important that the cement sheath surrounding the casing strings have a high degree of integrity. This means that the cement is fully squeezed into the annular region to prevent fluid communication between fluids at the level of subsurface completion and any aquifers residing just below the surface. Such fluids may include fracturing fluids, aqueous acid, and formation gas.

Heretofore, the integrity of a cement sheath has been determined through the use of a so-called cement bond long. A cement bond log (or CBL) uses an acoustic signal that is transmitted by a logging tool at the end of a wireline. The logging tool includes a transmitter, and then a receiver that "listens" for sound waves generated by the transmitter through the surrounding casing strings. The logging tool includes a signal processor that takes a continuous measurement of the amplitude of sound pulses from the transmitter to the receiver.

The theory behind the CBL is that the sound pulses will generally have a consistent amplitude when pulses are sent at the same frequency. However, if a section of pipe is not fully cemented in place, meaning that a gap exists in the cement sheath, the steel material making up the casing string will have more of a "ring" in response to the acoustic signal. This will manifest itself in the form of a greater amplitude of the sound pulses. Bond logs may also measure acoustic impedance of the cement or other material in the annulus behind the casing by resonant frequency decay.

Cement bond logs are typically run after a casing string has been cemented in placed within the wellbore. However, it is desirable to be able to evaluate the integrity of the cement sheath behind the casing string immediately after the cementing operation has been conducted and without need for a wireline or separate logging tool. Further, it is desirable to determine the progress of cement placement during the cementing operation using a series of communications nodes placed along the casing string as part of the well completion.

Another issue encountered during cementing operations relates to a so-called trapped annulus. A trapped annulus occurs when the fluid behind a casing string becomes sealed under pressure. This can be caused by cement or settled mud solids extending above the shoe of the outer string of casing while the top of the annulus is sealed by the design of the wellhead. When the fluid inside a trapped annulus is later heated by the production of reservoir fluids, the pressure in the annulus builds. This pressure can exceed the pressure rating of the inner string of casing. This, in turn, can lead to pipe collapse or even well failure.

Annular pressure cannot be detected using a CBL log. Further, in the context of subsea wells, subsea annular pressure generally cannot be monitored with permanent downhole pressure gauges that communicate information back to the surface using wires or cables. This is because electrical and optical conduits generally should not be passed through a subsea wellhead. Accordingly, a need exists for a wireless sensor network, such as an acoustic telemetry system, that enables the operator to receive signals from sensors along the casing, and to also transmit signals to a tool in a subsea well using high data transmission rates. Such signals are indicative of an annular condition, both at the time of cementing and shortly after completion.

SUMMARY OF THE INVENTION

An electro-acoustic system for downhole telemetry is provided herein. The system employs a series of communications nodes spaced along a wellbore. Each node transmits a signal that represents a packet of information. The packet of information includes both a node identifier and an acoustic wave. The signals are relayed up the wellbore from node-to-node in order to deliver a wireless signal to a receiver at the surface.

The telemetry system is designed to inform an operator about one or more conditions along an annular region within the wellbore. In the system, the wellbore is a cased-hole wellbore. Thus, the system first comprises a casing string that is disposed in the wellbore. A cement sheath resides at least partially within an annular region formed between the casing string and a surrounding subsurface rock matrix.

The system also includes a topside communications node. The topside communications node is placed proximate a well head of the wellbore outside the pressure regime. It is preferred that the wellbore be a subsea well, and that the well head reside over the wellbore on a bottom of a body of water. The body of water may be, for example, an ocean, a bay, or a deep estuary.

The system also includes a plurality of subsurface communications nodes. The subsurface communications nodes are spaced along the wellbore, and are attached to a wall of the casing string. Preferably, the subsurface communications nodes are clamped to an outer surface of the casing string. In one aspect, the communications nodes are spaced at between about 20 and 40 foot (6.1 to 12.2 meter) intervals. Preferably, each joint of pipe making up the casing string receives one node.

The system further includes one or more, and preferably two or more sensors. Each sensor is associated with a subsurface communications node. Preferably, each sensor resides within the steel housing of a node, and is in electrical communication with a processor. The sensors are configured to sense a parameter in the annular region.

In one aspect, the parameter to be monitored is pressure. In this instance, each of the sensors comprises a pressure sensor. In another aspect, the parameter to be monitored is pipe strain. In this instance, one or more of the sensors comprises a strain gauge along the casing. The electro-acoustic transceivers transmit acoustic signals up the wellbore representative of pressure readings and/or strain readings, node-to-node, as part of the packets of information. In still another instance, the parameter to be monitored is annular temperature. In this instance, one or more of the sensors comprises a temperature sensor. The electro-acoustic transceivers transmit acoustic signals up the wellbore representative of the temperature readings, node-to-node, as part of the packets of information.

Each of the subsurface communications nodes is configured to transmit acoustic waves up the wellbore. The waves represent signals indicative of a sensed parameter. Further, each signal contains information indicative of the location of the sensor generating the original parameter reading. Together, these signals represent a packet of information. The acoustic (or sonic) waves containing the packets of information are sent up to the topside communications node. The topside communications node then transmits the signals as either wired or wireless communications signals to a receiver at the surface.

Each of the subsurface communications nodes has a sealed housing. In addition, each node relies upon an independent power source. The power source may be, for example, batteries or a fuel cell. The power source resides within the housing.

In addition, each of the subsurface communications nodes has an electro-acoustic transducer. In one aspect, the communications nodes transmit data as mechanical waves at a rate exceeding about 50 bps. In one aspect, each of the acoustic waves represents a packet of information comprising a plurality of separate tones, with each tone having a non-prescribed amplitude, a non-prescribed reverberation time, or both. Multiple frequency shift keying (MFSK) may be used as a modulation scheme enabling the transmission of information.

As indicated above, the system also includes a receiver. The receiver is positioned at the surface and is configured to receive signals from the topside communications node. The signals originate via the various subsurface communications nodes. The receiver is in electrical communication with the topside communications node by means of an optical or electrical cable. Alternatively, a wireless data transmission such as Wi-Fi or Blue Tooth may be employed through the body of water. Alternatively, a wireless data transmission such as sonar or low-frequency radio waves may be used through water.

Preferably, the system also includes a sliding sleeve. The sliding sleeve resides along the casing string, such as near a top end of the casing string. When a sensor senses a condition indicative of a condition that suggests excessive pressure within an annular region, then an actuation signal is sent to the sliding sleeve. The sliding sleeve receives the signal, and in response causes the sliding sleeve to open. In this way, annular pressure around the casing is relieved, or vented, into the wellbore.

The actuation signal may originate from the surface, such as in response to an operator action. Alternatively, the actuation signal may originate from a processor in the sliding sleeve in response to an electrical signal received directly from a sensor, or in response to acoustic signals receive from the series of subsurface communications nodes.

A method for monitoring a condition in an annular region of a wellbore is also provided herein. The method uses a plurality of data transmission nodes situated along a casing string to accomplish a wireless transmission of data along the wellbore. The data represents signals that indicate a condition existing in the annular region. The condition may be, for example, the presence vel non of a cement sheath adjacent a respective communications nodes, or the integrity of the cement sheath. Alternatively, the condition may be the location of a top-of-cement within the annular region, which is indicative of a "trapped annulus." Alternatively still, the condition may be the presence of an extreme pressure condition, also known as a annular pressure buildup, or "APB."

In the method, the wellbore has a well head. The well head is placed proximate a bottom of a body of water. The body of water may be, for example, an ocean, a sea, a bay or a large lake. Thus, the wellbore is part of a subsea well.

The method first includes running joints of pipe into the wellbore. The joints of pipe, referred to as casing, are connected together at threaded couplings. The joints of pipe are fabricated from a steel material and have a resonance frequency.

The method also includes attaching a series of subsurface communications nodes to the joints of casing. The joints are attached according to a pre-designated spacing. In one aspect, each joint of pipe receives at least one communications node. Preferably, each of the communications nodes is attached to a joint of pipe by one or more clamps. In this instance, the step of attaching the subsurface communications nodes to the joints of pipe comprises clamping the communications nodes to an outer surface of the joints of pipe.

In the method, adjacent communications nodes are configured to communicate by acoustic signals transmitted through the joints of casing. The subsurface communications nodes are configured to transmit acoustic waves up the casing string, node-to-node. Each subsurface communications node includes an electro-acoustic transducer and associated transceiver that receives an acoustic signal from a previous communications node, and then transmits or relays that acoustic signal to a next communications node. In one aspect, the communications nodes transmit data as mechanical waves at a rate exceeding about 50 bps.

The method also comprises providing a plurality of sensors along the wellbore. Each sensor is configured to sense a parameter within the annular region. In addition, each sensor is in electrical communication with an associated subsurface communications node. In one aspect, each sensor resides within a steel housing of a subsurface communications node.

The method additionally includes placing a cement sheath within an annular region. The annular region is formed between the casing string and a surrounding subsurface rock matrix. The cement sheath is placed at least partially along the wellbore.

The method further includes attaching a topside communications node to the wellhead. The topside communications node comprises an electro-acoustic transducer and transceiver for receiving the acoustic signals from the subsurface communications nodes, and then transmitting signals containing packets of information relayed from the subsurface communications nodes. The signals are sent to a receiver at the surface using either a wire, or a wireless data transmission.

The method also includes analyzing the signals. The purpose for the analysis is to monitor a designated parameter. The parameter may be, for example, temperature, pressure, casing strain, or acoustic amplitudes of pipe.

Analyzing the signals will allow the operator to infer the quality of the cement sheath at and/or between the nodes. If it is determined that cement has not been properly placed around the casing string adjacent one of the communications nodes, then a so-called squeeze job may optionally be conducted to insert cement into the annular region around the joint of casing supporting that communications node through a perforation. Alternatively, the operator may try to squeeze additional cement through the casing shoe and up the annulus. If it is determined that annular pressure buildup is occurring, a signal may be sent to open a sleeve along the casing string and relieve pressure. Alternatively, the casing string may be perforated to relieve fluid pressure.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

In FIG. 5A, the leading edge, or front, of the shoe is seen. In FIG. 5B, the back of the shoe is seen.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (such as about 20° C. and 1 atm pressure). Hydrocarbon fluids may include, for example, oil, natural gas, gas condensates, coal bed methane, shale oil, pyrolysis oil, and other hydrocarbons that are in a gaseous or liquid state.

As used herein, the term "subsurface" refers to regions below the earth's surface.

As used herein, the term "sensor" includes any electrical sensing device or gauge. The sensor may be capable of monitoring or detecting pressure, temperature, fluid flow, vibration, resistivity, strain or other pipe or formation data.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refer to a portion of a formation containing hydrocarbons. The term "hydrocarbon-bearing formation" may alternatively be used. Zones of interest may also include formations containing brines which are to be isolated.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe, such as a joint of casing, a portion of a liner, a drill string, a production tubing, an injection tubing or a pup joint. A "joint of casing" may include a BOP or valve or other portion of a well head.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Figure 1:
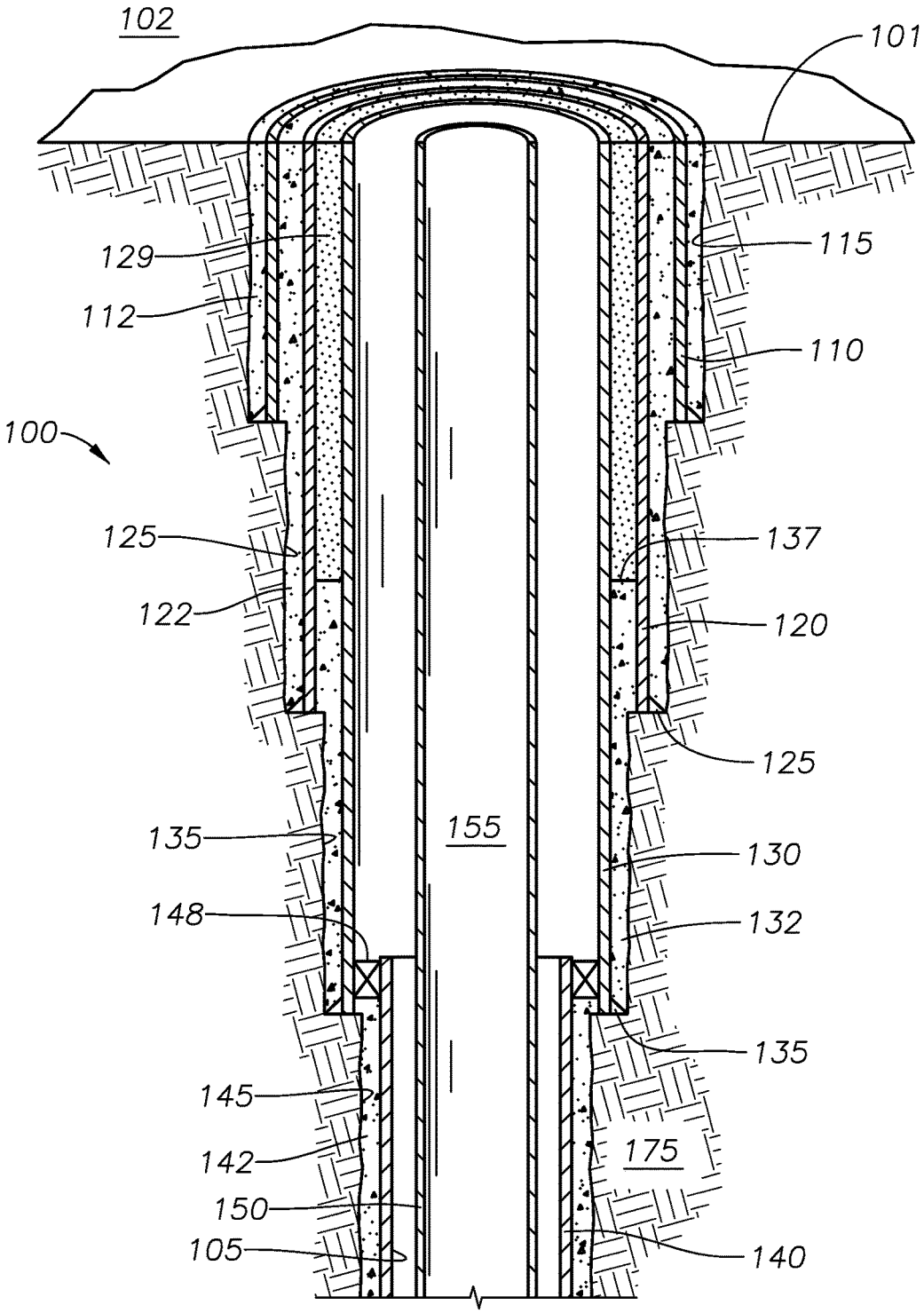
FIG. 1 is a side, cross-sectional view of a series of tubular bodies forming a wellbore. The tubular bodies extend from a surface and down into a subsurface formation.

FIG. 1 is a side, cross-sectional view of a portion of an illustrative wellbore 100. The wellbore 100 includes a series of tubular bodies 110, 120, 130, 140, 150. The tubular bodies 110, 120, 130, 140, 150 are arranged in a generally concentric pattern. Each of the tubular bodies 110, 120, 130, 140, 150 has been lowered into a subterranean region 175 from a surface 101.

The process of placing the tubular bodies 110, 120, 130, 140, 150 into the subterranean region 175 is done using a drilling rig. A drilling rig is not shown in FIG. 1; however, those of ordinary skill in the art of well completions will understand that different types of drilling rigs may be used to form wellbores for the recovery of hydrocarbon fluids.

In the arrangement of FIG. 1, the wellbore 100 is intended to be placed in a subsea environment. Accordingly, reference number 101 is intended to indicate an ocean bottom, while reference number 102 is intended to indicate an ocean. Of course, the area shown by reference 102 may be another large body of water 102 such as a bay, a deep estuary or a large lake. The drilling rig will typically be a floating vessel that supports a derrick, a semi-submersible offshore rig, or a jack-up rig. It is noted though that the claims provided herein are not limited by the configuration and features of the drilling rig used to form the wellbore.

The wellbore 100 of FIG. 1 includes a first string of casing 110. The first string of casing 110 extends from the surface 101. This is known as surface casing 110 or, in some instances (particularly offshore), conductor pipe. The surface casing 110 is secured within the subterranean region 175 by a cement sheath 112. The cement sheath 112 resides within an annular region 115 between the surface casing 110 and the surrounding earth formation.

Additional strings of casing have also been used in completing the wellbore 100. These include a second string of casing 120 and a third string of casing 130. The second string of casing 120 resides generally concentrically within the conductor pipe 110, forming an annular region 125 between the second string of casing 120 and the conductor pipe 110. Similarly, the third string of casing 130 resides generally concentrically within the second string of casing 120, forming an annular region 135 between the third string of casing 130 and the surrounding second string 120. Cement sheaths 122, 132 are placed behind casing strings 120, 130, respectively.

The second string of casing 120 extends to a depth below that of the conductor pipe 110. This means that the annular region 125 also extends below the conductor pipe 110. Similarly, the third string of casing 130 extends to a depth below that of the second string of casing 120. This means that the annular region 135 also extends below the second string of casing 120.

The wellbore 100 is also completed with a fourth string of casing 140. Here, the fourth string of casing 140 is actually a liner string, meaning that it is hung from the third string of casing 130 using a liner hanger 148. An annular region 145 resides between the fourth string of casing 140 and the surrounding earth formation in the subterranean region 175. A cement sheath 142 has been placed in the annular region 145.

The wellbore 100 further includes an optional string of production tubing 150. The production tubing 150 has a bore 155 that extends from the surface 101 down into the subterranean region 175. The production tubing 150 serves as a conduit for the production of reservoir fluids, such as hydrocarbon liquids. An annular region 105 is formed between the production tubing 150 and the surrounding tubular bodies 130, 140.

In the completion of FIG. 1, the annular regions 115, 125, 135 and 145 are at least partially filled, or "squeezed," with cement. Line 137 indicates a top-of-cement line in annular region 135. Wellbore liquids and solids reside at 129 above line 137. This may be by design, or may be a result of a poor or incomplete cement squeeze job.

In connection with completing wellbore 100, the operator will wish to evaluate the integrity of the cement sheath surrounding the various casing strings 110, 120, 130, 140 during completion. To do this, the industry has relied upon so-called cement bond logs. As discussed above, a cement bond log (or CBL), uses an acoustic signal that is transmitted by a logging tool at the end of a wireline. The logging tool includes a transmitter, and then a receiver that "listens" for sound waves generated by the transmitter through the surrounding casing string. The logging tool includes a signal processor that takes a continuous measurement of the amplitude of sound pulses from the transmitter to the receiver.

In some instances, a bond log will measure acoustic impedance of the material in the annulus directly behind the casing. This may be done through resonance frequency decay. Such logs include, for example, the USIT log of Schlumberger (of Sugar Land, Tex.) and the CAST-V log of Halliburton (of Houston, Tex.).

It is desirable to implement a downhole telemetry system that enables the operator to evaluate cement sheath integrity without need of running a CBL line. This enables the operator to check cement sheath integrity as soon as the cement has been set in an annular region or as the wellbore 100 is being completed.

Further, the operator will wish to monitor pressure levels residing in the annular regions 115, 125, 135 and/or 145 when production operations commence. However, such operations are problematic, particularly in the context of a subsea operation where cables generally cannot be passed through a subsea well head to deliver signals to the surface.

Accordingly, a sensor network using a plurality of wireless communications nodes is offered herein.

Figure 2:
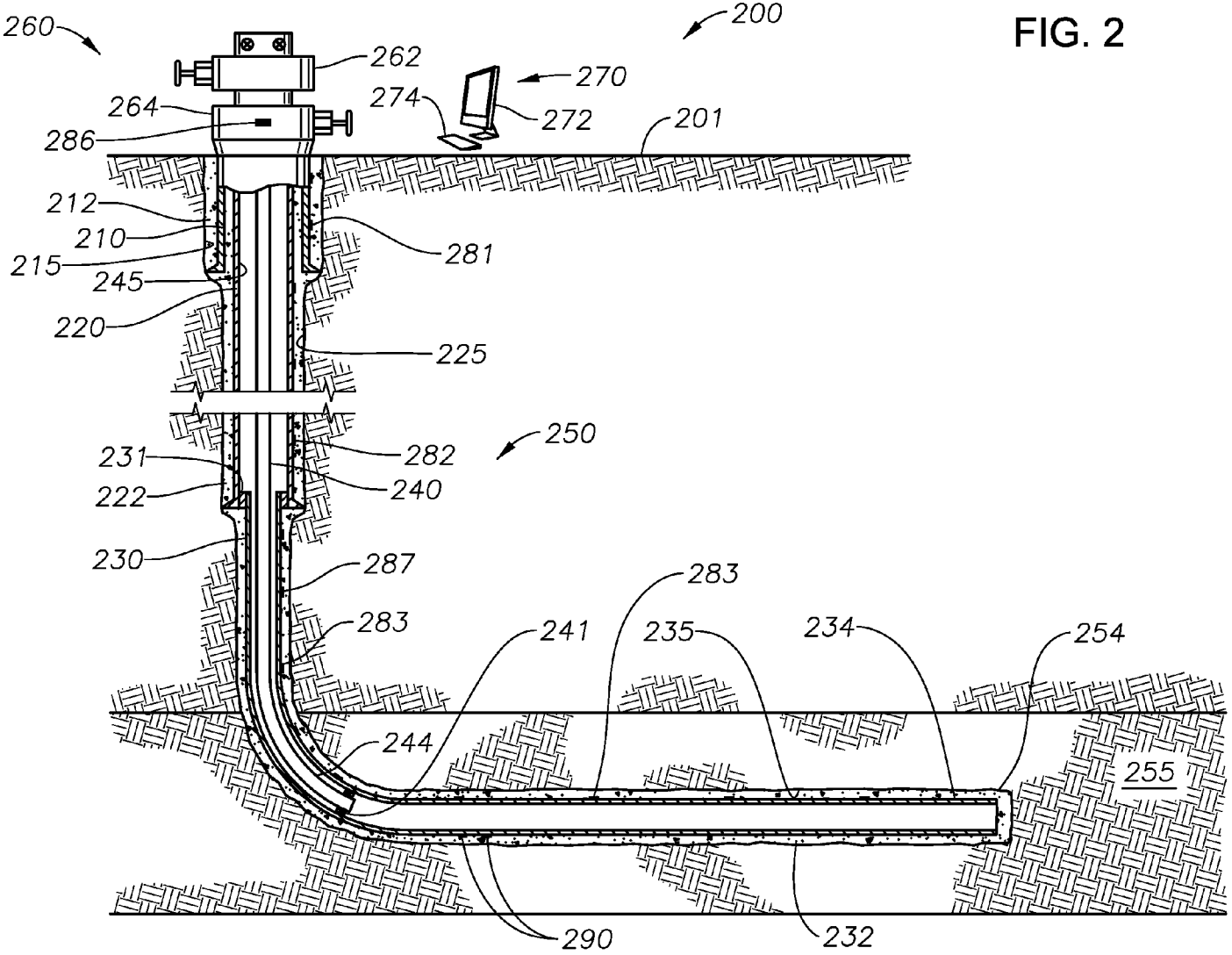
FIG. 2 is a cross-sectional view of a wellbore having been completed. The illustrative wellbore has been completed as a cased hole completion. A series of communications nodes is placed along the casing strings to form telemetry systems.

FIG. 2 presents a cross-sectional view of an illustrative well site 200. The well site 200 includes a wellbore 250 that penetrates into a subsurface formation 255. The wellbore 250 has been completed as a cased-hole completion for producing hydrocarbon fluids.

The well site 200 also includes a well head 260. The well head 260 is positioned at a surface 201 to control and direct the flow of formation fluids from the subsurface formation 255 to the surface 201. The surface 201 is intended to indicate the bottom of a body of water, such as an estuary, an ocean, a sea, or a large lake.

Referring first to the well head 260, the well head 260 may be any arrangement of pipes or valves that receive reservoir fluids at the top of the well. In the arrangement of FIG. 2, the well head 260 represents a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264.

The wellbore 250 has been completed with a series of pipe strings referred to as casing. First, a string of surface casing 210 has been cemented into the formation. The cement resides in an annular region 215 around the casing 210, forming an annular sheath 212. The surface casing 110 has an upper end in sealed connection with the lower valve 264.

Next, at least one intermediate string of casing 220 is cemented into the wellbore 250. The intermediate string of casing 220 is in sealed fluid communication with the upper master valve 262. A cement sheath 222 resides in an annular region 225 of the wellbore 250. The combination of the casing 210/220 and the cement sheaths 212, 222 in the annular regions 215, 225 strengthens the wellbore 250 and facilitates the isolation of formations behind the casing 210/220.

It is understood that a wellbore 250 may, and typically will, include more than one string of intermediate casing, as shown in the wellbore 100 of FIG. 1. In some instances, an intermediate string of casing may be a liner.

Finally, a production string 230 is provided. The production string 230 is hung from the intermediate casing string 230 using a liner hanger 231. The production string 230 is a liner that is not tied back to the surface 101. In the arrangement of FIG. 2, a cement sheath 232 is provided around the liner 230. The cement sheath 232 fills an annular region 235 between the liner 230 and the surrounding rock matrix in the subsurface formation 255.

The production liner 230 has a lower end 234 that extends to an end 254 of the wellbore 250. For this reason, the wellbore 250 is said to be completed as a cased-hole well. Those of ordinary skill in the art will understand that for production purposes, the liner 230 will be perforated after cementing to create fluid communication between a bore 235 of the liner 230 and the surrounding rock matrix making up the subsurface formation 255. In one aspect, the production string 230 is not a liner but is a casing string that extends back to the surface.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place.

The wellbore 250 optionally also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 241 is provided at a lower end 244 of the production tubing 240 to seal off an annular region 245 between the tubing 240 and the surrounding production liner 230. However, the production tubing 240 may extend closer to the end 234 of the liner 230.

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enable the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

Horizontally completed wells enjoy other advantages. These include the ability to penetrate into subsurface formations that are not located directly below the wellhead. This is particularly beneficial where an oil reservoir is located under an urban area or under a large body of water. Another benefit of directional drilling is the ability to group multiple wellheads on a single platform, such as for offshore drilling. Finally, directional drilling enables multiple laterals and/or sidetracks to be drilled from a single vertical wellbore in order to maximize reservoir exposure and recovery of hydrocarbons.

In each of FIGS. 1 and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down," or "upper" and "lower," or similar terms are used in reference to a drawing, they are intended to indicate relative location on the drawing page, and not necessarily orientation in the ground, as the present inventions have utility no matter how the wellbore is orientated.

The well site 200 of FIG. 2 includes a telemetry system that utilizes a series of novel communications nodes. This is for the purpose of monitoring one or more parameters in an annular region. The parameters, in turn, are indicative of conditions downhole. An example of a condition is the integrity of a cement sheath, such as sheath 232. Another example of a condition is the top-of-cement line behind the casing, such as line 137 in the wellbore 100 of FIG. 1. These conditions may be inferred through parameters such as temperature, pressure and casing strain. Affirmative monitoring of these parameters will preferably taking place during or shortly after the cementing operation for each successive string of casing.

In the completion of FIG. 2, subsurface communications nodes 281 are placed along an outer surface of the surface casing 210. Additionally, subsurface communications nodes 282 are optionally placed along the intermediate casing 220. Additionally still, subsurface communications nodes 283 are placed along an outer surface of the liner 230. Optionally, though not shown, communications nodes may also be placed along the production tubing 240. The communications nodes allow for the high speed transmission of wireless signals based on the in situ generation of mechanical waves using acoustic transducers.

Each of the subsurface communications nodes 281, 282, 283 is configured to receive and then relay acoustic signals along a respective string of casing. Preferably, the subsurface communications nodes 281, 282, 283 utilize two-way electro-acoustic transducers to receive and relay mechanical (or acoustic) waves. The acoustic waves are preferably at a frequency band of between about 50 kHz and 500 kHz. Communication may be between adjacent nodes or may skip nodes depending on node spacing or communication range. Preferably, communication is routed around nodes which are broken.

In addition, to the subsurface communications nodes 281, 282, 283, a topside communications node 286 is used. The topside communications node 286 is placed on or proximate to the wellhead 260. The topside node 286 is configured to receive acoustic signals generated by the subsurface communications nodes 281, 282, 283, convert those signals to digital signals, and then send the digital signals on to a receiver at the surface. Thus, signals indicative of a parameter in the annular region are sent from node-to-node, and then up to a drilling engineer or rig operator at the surface via a receiver.

The well site 200 of FIG. 2 shows a receiver 270. The receiver 270 comprises a processor 272 that receives signals sent from the topside communications node 286. The processor 272 may include discrete logic, any of various integrated circuit logic types, or a microprocessor. The receiver 270 may include a screen and a keyboard 274 (either as a keypad or as part of a touch screen). The receiver 270 may also be an embedded controller with neither a screen nor a keyboard which communicates with a remote computer via cellular modem or telephone lines.

In one aspect, the signals are received by the processor 272 through a wire (not shown) such as a co-axial cable, a fiber optic cable, a USB cable, or other electrical or optical communications wire. The receiver 270 preferably receives electrical signals via a so-called Class I, Div. 1 conduit, that is, a wiring system or circuitry that is considered acceptably safe in an explosive environment. More preferably, the receiver 270 receive the final signals from the topside node 286 wirelessly through a modem or transceiver.

The communications nodes 281, 282, 283 are specially designed to withstand the same corrosive and environmental conditions (high temperature, high pressure) of a wellbore 250 as the casing and production tubing. To do so, it is preferred that the communications nodes 281, 282, 283 include steel housings for holding electronics and sensors. In one aspect, the steel material is a corrosion resistant alloy.

In FIG. 2, the nodes 281, 282, 283 are shown schematically. However, FIG. 3 offers an enlarged perspective view of an illustrative pipe joint 300, along with a communications node 350. The illustrative communications node 350 is shown exploded away from the pipe joint 300 for reference.

Figure 3:
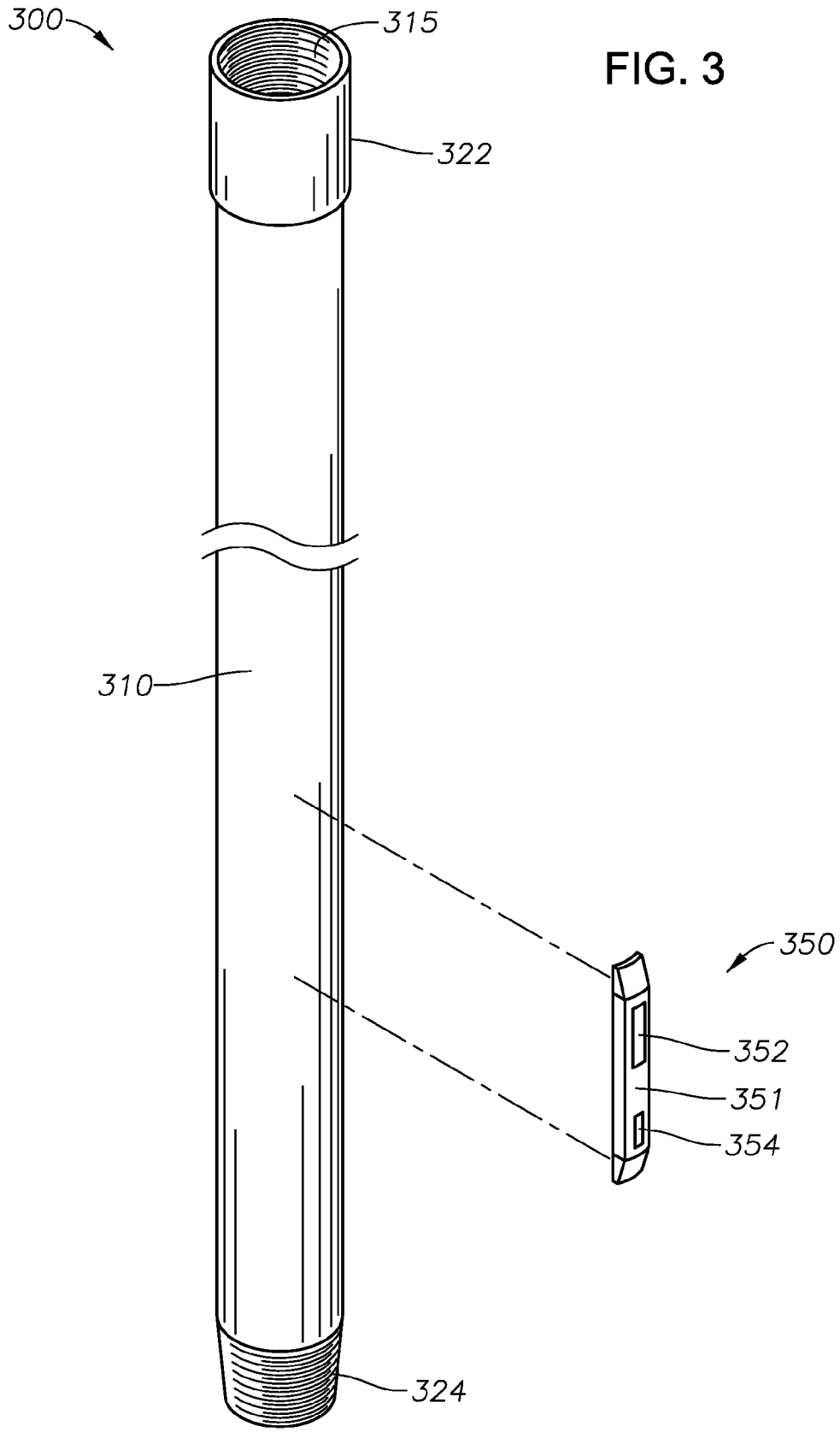
FIG. 3 is a perspective view of an illustrative pipe joint. A communications node of the present invention, in one embodiment, is shown exploded away from the pipe joint.

In FIG. 3, the pipe joint 300 is intended to represent a joint of casing. However, the pipe joint 300 may be any other tubular body such as a joint of tubing. The pipe joint 300 has an elongated wall 310 defining an internal bore 315. The bore 315 transmits drilling fluids such as an oil based mud, or OBM, during a drilling operation. The bore 315 also receives a string of tubing (such as production tubing or injection tubing, not shown), once a wellbore is completed.

The pipe joint 300 has a box end 322 having internal threads. In addition, the pipe joint 300 has a pin end 324 having external threads. The threads may be of any design.

As noted, an illustrative communications node 350 is shown exploded away from the pipe joint 300. The communications node 350 is designed to attach to the wall 310 of the pipe joint 300 at a selected location. In one aspect, each pipe joint 300 will have a communications node 350 between the box end 322 and the pin end 324. In one arrangement, the communications node 350 is placed immediately adjacent the box end 322 or, alternatively, immediately adjacent the pin end 324 of every joint of pipe. In another arrangement, the communications node 350 is placed at a selected location along every second or every third pipe joint 300 in a drill string 160. In still another arrangement, at least some pipe joints 300 receive two communications nodes 350.

The communications node 350 shown in FIG. 3 is designed to be pre-welded onto the wall 310 of the pipe joint 300. Alternatively, the communications node 350 may be glued using an adhesive such as epoxy. However, it is preferred that the communications node 350 be configured to be selectively attachable to/detachable from a pipe joint 300 by mechanical means at a well site. This may be done, for example, through the use of clamps. Such a clamping system is shown at 600 in FIG. 6, described more fully below. In any instance, the communications node 350 is an independent wireless communications device that is designed to be attached to an external surface of a well pipe.

There are benefits to the use of an externally-placed communications node that uses acoustic waves. For example, such a node will not interfere with the flow of fluids within the internal bore 315 of the pipe joint 300. Further, installation and mechanical attachment can be readily assessed and adjusted.

In FIG. 3, the communications node 350 includes an elongated body 351. The body 351 supports one or more batteries, shown schematically at 352. The body 351 also supports an electro-acoustic transducer, shown schematically at 354. The electro-acoustic transducer 354 is associated with a transceiver that receives acoustic signals at a first frequency, converts the received signals into a digital signal, converts the digital signal back into an acoustic signal, and transmits the acoustic signal at a second frequency to a next communications node.

The communications node 350 is intended to represent any of the communications nodes 281, 282, 282 of FIG. 2, in one embodiment. The electro-acoustic transducer 354 in each node 180 allows signals to be sent from node-to-node, up the wellbore 250, as acoustic waves. The acoustic waves may be at a frequency of, for example, between about 100 kHz and 125 kHz. A last subsurface communications node transmits the signals to the topside node 286. Beneficially, the subsurface communications nodes 350 do not require a wire or cable to transmit data up or down the wellbore. Preferably, communication is routed around nodes which are broken.

Figure 4A:
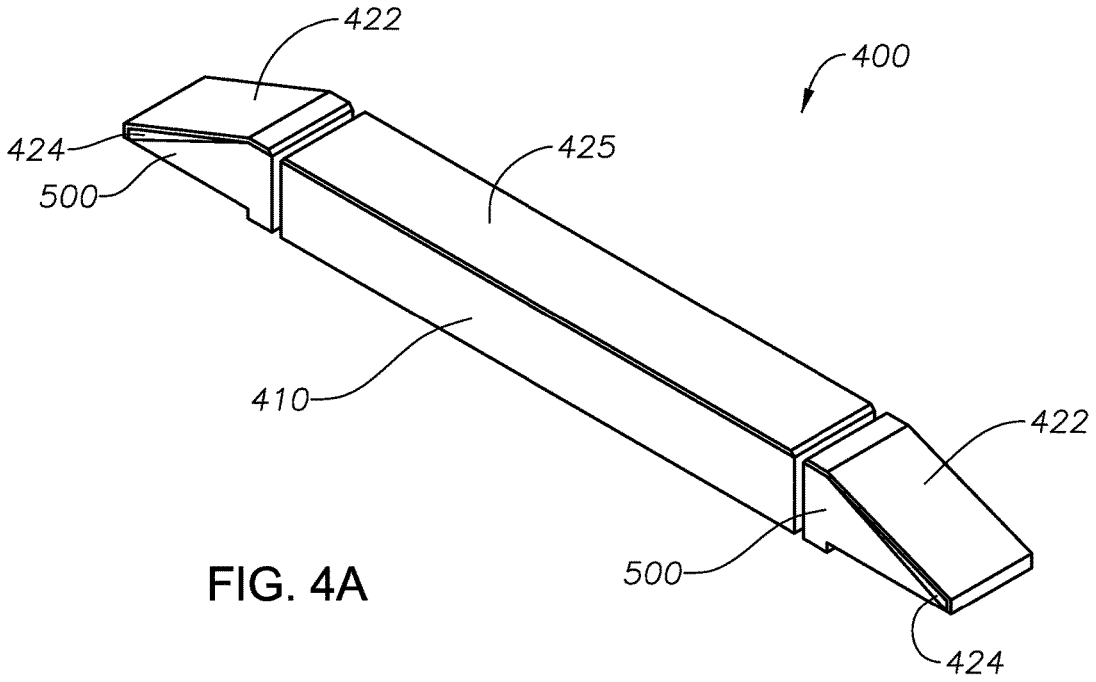
FIG. 4A is a perspective view of a communications node as may be used in the acoustic telemetry systems of the present invention, in an alternate embodiment.
Figure 4B:
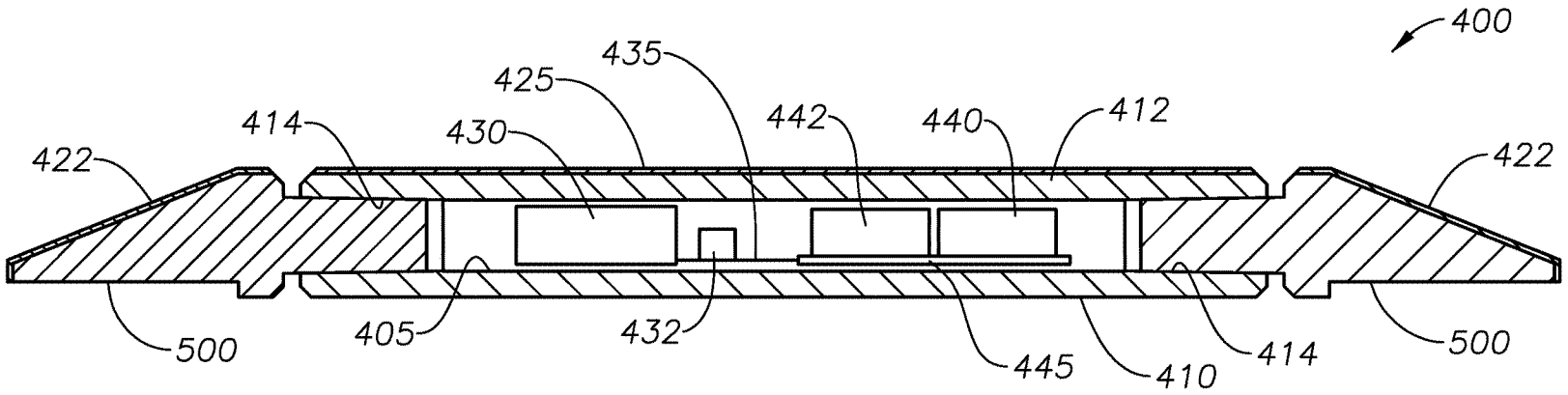
FIG. 4B is a cross-sectional view of the communications node of FIG. 4A. The view is taken along the longitudinal axis of the node. Here, a sensor is provided within the communications node.

FIG. 4A is a perspective view of a communications node 400 as may be used in the wireless data transmission systems of FIG. 1 or FIG. 2 (or other wellbore), in one embodiment. The communications node 400 is designed to provide data communication using a transceiver within a novel downhole housing assembly. FIG. 4B is a cross-sectional view of the communications node 400 of FIG. 4A. The view is taken along the longitudinal axis of the node 400. The communications node 400 will be discussed with reference to FIGS. 4A and 4B, together.

The communications node 400 first includes a fluid-sealed housing 410. The housing 410 is designed to be attached to an outer wall of a joint of wellbore pipe, such as the pipe joint 300 of FIG. 3. Where the wellbore pipe is a carbon steel pipe joint such as drill pipe, casing or liner, the housing 410 is preferably fabricated from carbon steel. This metallurgical match avoids galvanic corrosion at the coupling.

The housing 410 includes an outer wall 412. The wall 412 is dimensioned to protect internal electronics for the communications node 400 from wellbore fluids and pressure. In one aspect, the wall 412 is about 0.2 inches (0.51 cm) in thickness. The housing 410 optionally also has a protective outer layer 425. The protective outer layer 425 resides external to the wall 412 and provides an additional thin layer of protection for the electronics.

A bore 405 is formed within the wall 412. The bore 405 houses the electronics, shown in FIG. 4B as a battery 430 and a power supply wire 435. An example of a battery 430 suitable for the anticipated downhole environment is one or more lithium primary cells.

The electronics of FIG. 4B also include a transceiver 440 and a circuit board 445. The circuit board 445 will preferably include a micro-processor or electronics module that processes acoustic signals. An electro-acoustic transducer 442 is provided to convert acoustical energy to electrical energy (or vice-versa) and is coupled with outer wall 412 on the side attached to the tubular body. The transducer 442 is in electrical communication with a sensor 432.

Figure 4C:
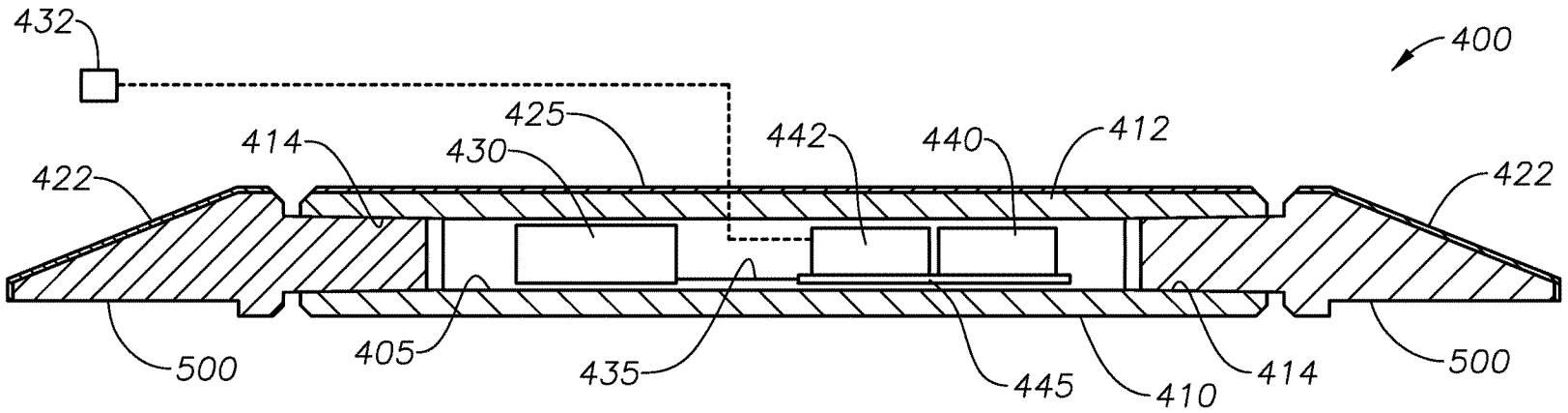
FIG. 4C is another cross-sectional view of the communications node of FIG. 4A. The view is again taken along the longitudinal axis of the node. Here, a sensor resides external to the communications node.

It is noted that in FIG. 4B, the sensor 432 resides within the housing 410 of the communications node 400. However, as noted, the sensor 432 may reside external to the communications node 400, such as above or below the node 400 along the wellbore. In FIG. 4C, a dashed line is provided showing an extended connection between the sensor 432 and the electro-acoustic transducer 442. The sensor 432 of FIG. 4C preferably resides in close proximity to the communications node 400, such as within one meter.

The transceiver 440 will receive an acoustic telemetry signal. In one preferred embodiment, the acoustic telemetry data transfer is accomplished using multiple frequency shift keying (MFSK). Any extraneous noise in the signal is moderated by using well-known conventional analog and/or digital signal processing methods. This noise removal and signal enhancement may involve conveying the acoustic signal through a signal conditioning circuit using, for example, a bandpass filter.

The transceiver will also produce acoustic telemetry signals. In one preferred embodiment, an electrical signal is delivered to an electromechanical transducer, such as through a driver circuit. In a preferred embodiment, the transducer is the same electro-acoustic transducer that originally received the MFSK data. The signal generated by the electro-acoustic transducer then passes through the housing 410 to the tubular body (such as production casing 230), and propagates along the tubular body to other communication nodes. The re-transmitted signal represents the same sensor data originally transmitted by sensor communications node 281, 282 or 283. In one aspect, the acoustic signal is generated and received by a magnetostrictive transducer comprising a coil wrapped around a core as the transceiver. In another aspect, the acoustic signal is generated and received by a piezo-electric ceramic transducer. In either case, the electrically encoded data are transformed into a sonic wave that is carried through the wall of the tubular body in the wellbore.

Each transceiver 440 is associated with a specific joint of pipe. That joint of pipe, in turn, has a known location or depth along the wellbore. The acoustic wave as originally transmitted from the transceiver 440 will represent a packet of information. The packet will include an identification code that tells a receiver (such as receiver 270 in FIG. 2) where the signal originated, that is, which communications node 400 it came from. In addition, the packet will include an amplitude value originally recorded by the communications node 400 for its associated joint of pipe.

When the signal reaches the receiver 270 at the surface, the signal is processed. This involves identifying which communications node the signal originated from, and then determining the location of that communications node along the wellbore. This further involves comparing the original amplitude value with a baseline value. The baseline value represents an anticipated value for a joint of casing having a fluid residing within its bore and a continuous cement sheath along its outer surface.

If the measured amplitude value is at or below the baseline amplitude value, then the operator can assume that a cement sheath has been placed around the joint of pipe at issue. On the other hand, if the measured amplitude value is above the baseline amplitude value, then the operator should assume that a poor cement sheath has been placed around the joint of pipe at issue. In that instance, remedial steps must be taken. Where the wellbore is presently undergoing a cementing operation, such steps may include further injecting cement through a cement shoe and up the annular region in the hopes of filling the annular region under additional or greater pressure. More likely, where the wellbore has been completed, such steps may include placing perforations in the casing at the subject joint of pipe, and then conducting a so-called "cement squeeze" in order to isolate the joint of pipe and fill the annular region at the depth of that joint of pipe. Alternatively, the operator may elect to forego perforating casing at that depth or along a certain zone of interest.

The communications node 400 optionally also includes one or more sensors, such as sensor 432. The sensors 432 may be, for example, pressure sensors, temperature sensors, strain gauges or microphones. The sensor 432 sends signals to the transceiver 440 through a short electrical wire 435 or through the printed circuit board 445. Signals from the sensor 432 are converted into acoustic signals using an electro-acoustic transducer, that are then sent by the transceiver 440 as part of the packet of information.

In one aspect, the sensor 432 is a temperature sensor. The packet of information will then include signals representative of temperature readings taken by the temperature sensor from an associated communications node 400. When the signal reaches the receiver at the surface or on the rig, the signal is compared with a baseline value. The baseline value represents an anticipated temperature for a joint of casing having a fresh column of cement residing there around. Those of ordinary skill in the art of well completions will understand that cement mix undergoes an exothermic reaction during setting which causes an increase in temperature.

If the measured temperature value is at or above the baseline temperature value, then the operator can assume that a cement sheath has been placed around the joint of pipe at issue. On the other hand, if the measured temperature value is below the baseline temperature value, then the operator should assume that a poor cement sheath has been placed around the joint of pipe at issue. Appropriate remedial steps may then be considered.

Additional methods of processing temperature data may be used. For example, the receiver may collect temperature data from a designated number of communications nodes that are in proximity to the subject communications node.

Temperature readings will then be averaged to determine a moving average temperature value for a section of casing. The measured temperature reading will then be compared to the moving average temperature value to determine cement integrity at the level of a particular joint of pipe.

Ideally, the operator will review a combination of amplitude data and temperature data along the wellbore to confirm cement sheath integrity. It is also noted that for purposes of monitoring pure acoustic amplitude, the electro-acoustic transducers themselves can serve as sensors.

The communications node 400 also optionally includes a shoe 500. More specifically, the node 400 includes a pair of shoes 500 disposed at opposing ends of the wall 412. Each of the shoes 500 provides a beveled face that helps prevent the node 400 from hanging up on an external tubular body or the surrounding earth formation, as the case may be, during run-in or pull-out. The shoes 500 may have a protective outer layer 422 and an optional cushioning material 424 under the outer layer 422.

Figure 5A:
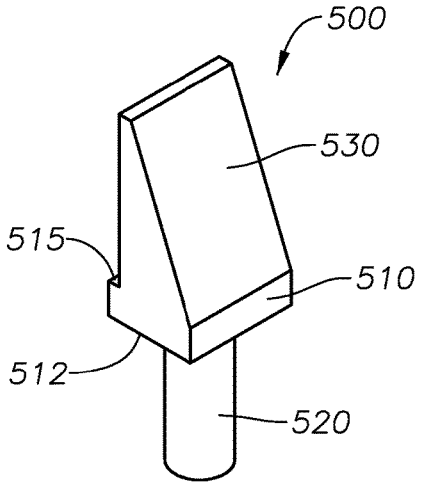
FIGS. 5A and 5B are perspective views of a shoe as may be used on opposing ends of the communications node of FIG. 4A, in one embodiment.
Figure 5B:
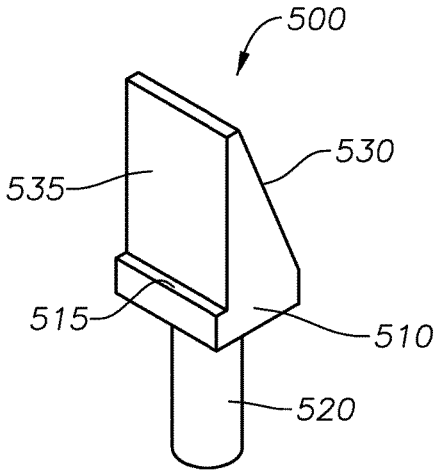

FIGS. 5A and 5B are perspective views of an illustrative shoe 500 as may be used on an end of the communications node 400 of FIG. 4A, in one embodiment. In FIG. 5A, the leading edge or front of the shoe 500 is seen, while in FIG. 4B the back of the shoe 500 is seen.

The shoe 500 first includes a body 510. The body 510 includes a flat under-surface 512 that butts up against opposing ends of the wall 412 of the communications node 400.

Extending from the under-surface 512 is a stem 520. The illustrative stem 520 is circular in profile. The stem 520 is dimensioned to be received within opposing recesses 414 of the wall 412 of the node 400.

Extending in an opposing direction from the body 510 is a beveled surface 530. As noted, the beveled surface 530 is designed to prevent the communications node 400 from hanging up on an object during run-in into a wellbore.

Behind the beveled surface 530 is a flat (or slightly arcuate) surface 535. The surface 535 is configured to extend along the drill string 160 (or other tubular body) when the communications node 400 is attached along the tubular body. In one aspect, the shoe 500 includes an optional shoulder 515. The shoulder 515 creates a clearance between the flat surface 535 and the tubular body opposite the stem 520.

The shoes 500 are preferably attached to the body 410 of the node 400 by welding. Welding preferably takes place before the nodes are delivered to the well site to avoid the presence of sparks. In another arrangement, the shoes 500 are applied through a glue, or by using a threaded connection with threads and gaskets.

In one arrangement, the communications nodes 400 with the shoes 500 are welded onto an outer surface of the tubular body, such as wall 310 of the pipe joint 300. More specifically, the body 410 of the respective communications nodes 400 are welded onto the wall of a joint of casing. In some cases, it may not be feasible or desirable to pre-weld the communications nodes 400 onto pipe joints before delivery to a well site. Further still, welding may degrade the tubular integrity or damage electronics in the housing 410. Therefore, it is desirable to utilize a clamping system that allows a drilling or service company to mechanically connect/disconnect the communications nodes 400 along a tubular body as the tubular body is being run into a wellbore.

Figure 6:
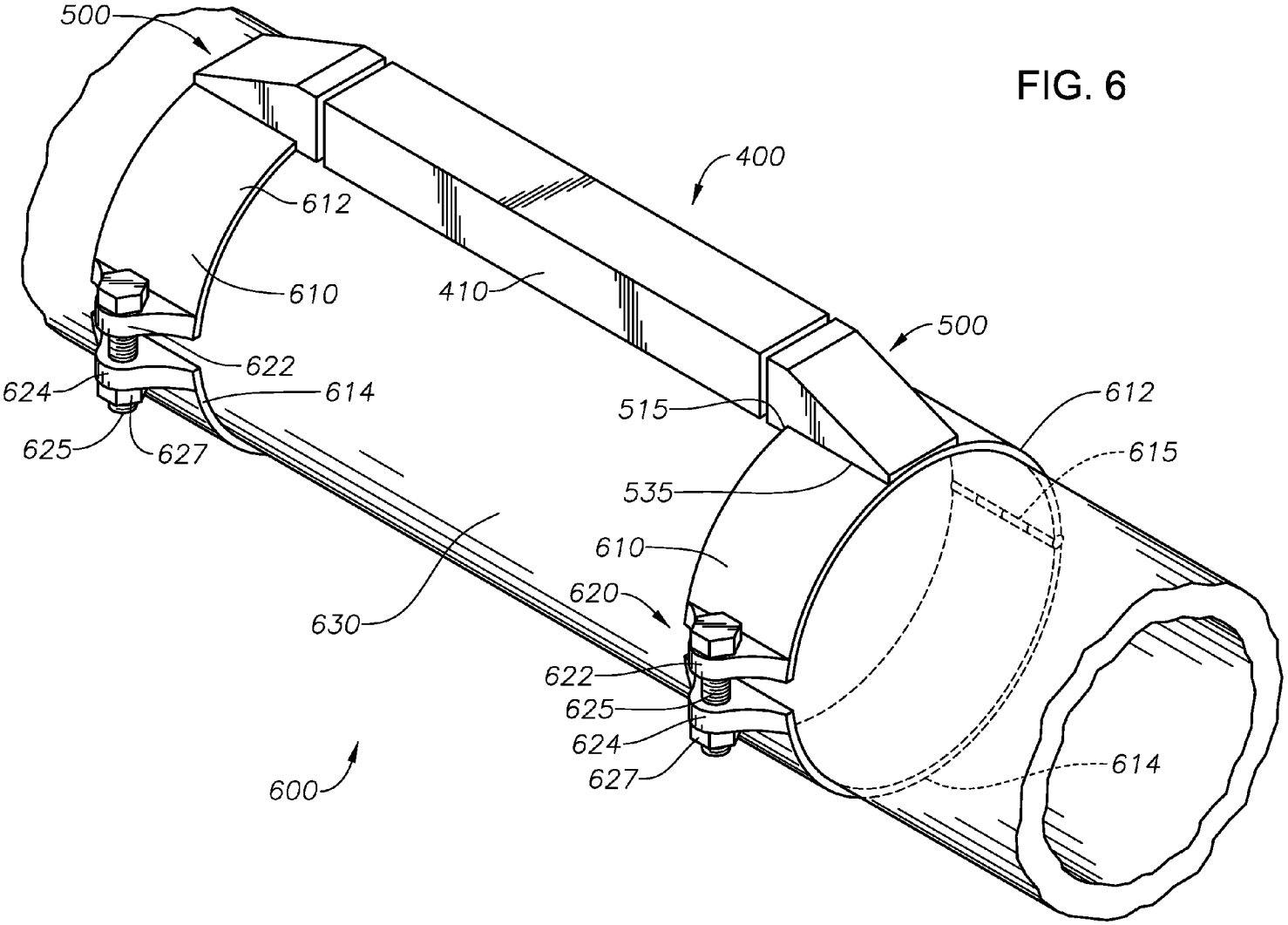
FIG. 6 is a perspective view of a communications node system as may be used in the methods of the present invention, in one embodiment. The communications node system utilizes a pair of clamps for connecting a subsurface communications node onto a tubular body.

FIG. 6 is a perspective view of a communications node system 600 as may be used for methods of the present invention, in one embodiment. The communications node system 600 utilizes a pair of clamps 610 for mechanically connecting a communications node 400 onto a tubular body 630 such as a joint of casing or liner.

The system 600 first includes at least one clamp 610. In the arrangement of FIG. 6, a pair of clamps 610 is used. Each clamp 610 abuts the shoulder 515 of a respective shoe 500. Further, each clamp 610 receives the base 535 of a shoe 500. In this arrangement, the base 535 of each shoe 500 is welded onto an outer surface of the clamp 610. In this way, the clamps 610 and the communications node 400 become an integral tool.

The illustrative clamps 610 of FIG. 6 include two arcuate sections 612, 614. The two sections 612, 614 pivot relative to one another by means of a hinge. Hinges are shown in phantom at 615. In this way, the clamps 610 may be selectively opened and closed.

Each clamp 610 also includes a fastening mechanism 620. The fastening mechanisms 620 may be any means used for mechanically securing a ring onto a tubular body, such as a hook or a threaded connector. In the arrangement of FIG. 6, the fastening mechanism is a threaded bolt 625. The bolt 625 is received through a pair of rings 622, 624. The first ring 622 resides at an end of the first section 612 of the clamp 610, while the second ring 624 resides at an end of the second section 614 of the clamp 610. The threaded bolt 625 may be tightened by using, for example, one or more washers (not shown) and threaded nuts 627.

In operation, a clamp 610 is placed onto the tubular body 630 by pivoting the first 612 and second 614 arcuate sections of the clamp 610 into an open position. The first 612 and second 614 sections are then closed around the tubular body 630, and the bolt 625 is run through the first 622 and second 624 receiving rings. The bolt 625 is then turned relative to the nut 627 in order to tighten the clamp 610 and connected communications node 400 onto the outer surface of the tubular body 630. Where two clamps 610 are used, this process is repeated.

The tubular body 630 may be, for example, a drill string such as the illustrative drill string 160 of FIG. 1. Alternatively, the tubular body 630 may be a string of production tubing such as the tubing 240 of FIG. 2. In any instance, the wall 412 of the communications node 400 is fabricated from a steel material having a resonance frequency compatible with the resonance frequency of the tubular body 630. Stated another way, the mechanical resonance of the wall 412 is at a frequency contained within the frequency band used for telemetry.

In one aspect, the communications node 400 is about 12 to 16 inches (0.30 to 0.41 meters) in length as it resides along the tubular body 630. Specifically, the housing 410 of the communications node may be 8 to 10 inches (0.20 to 0.25 meters) in length, and each opposing shoe 500 may be 2 to 5 inches (0.05 to 0.13 meters) in length. Further, the communications node 400 may be about 1 inch in width and inch in height. The base 410 of the communications node 400 may have a concave profile that generally matches the radius of the tubular body 630.

Using a plurality of the communications nodes 400, a method for monitoring a condition in an annular region of a wellbore is also provided herein. The condition may be the integrity of a cement sheath along the annular region. Alternatively, the condition may be the location of a top-of-cement within the annular region. Alternatively still, the condition may be the presence of an extreme pressure condition, also known as a "trapped annulus."

Figure 7A:
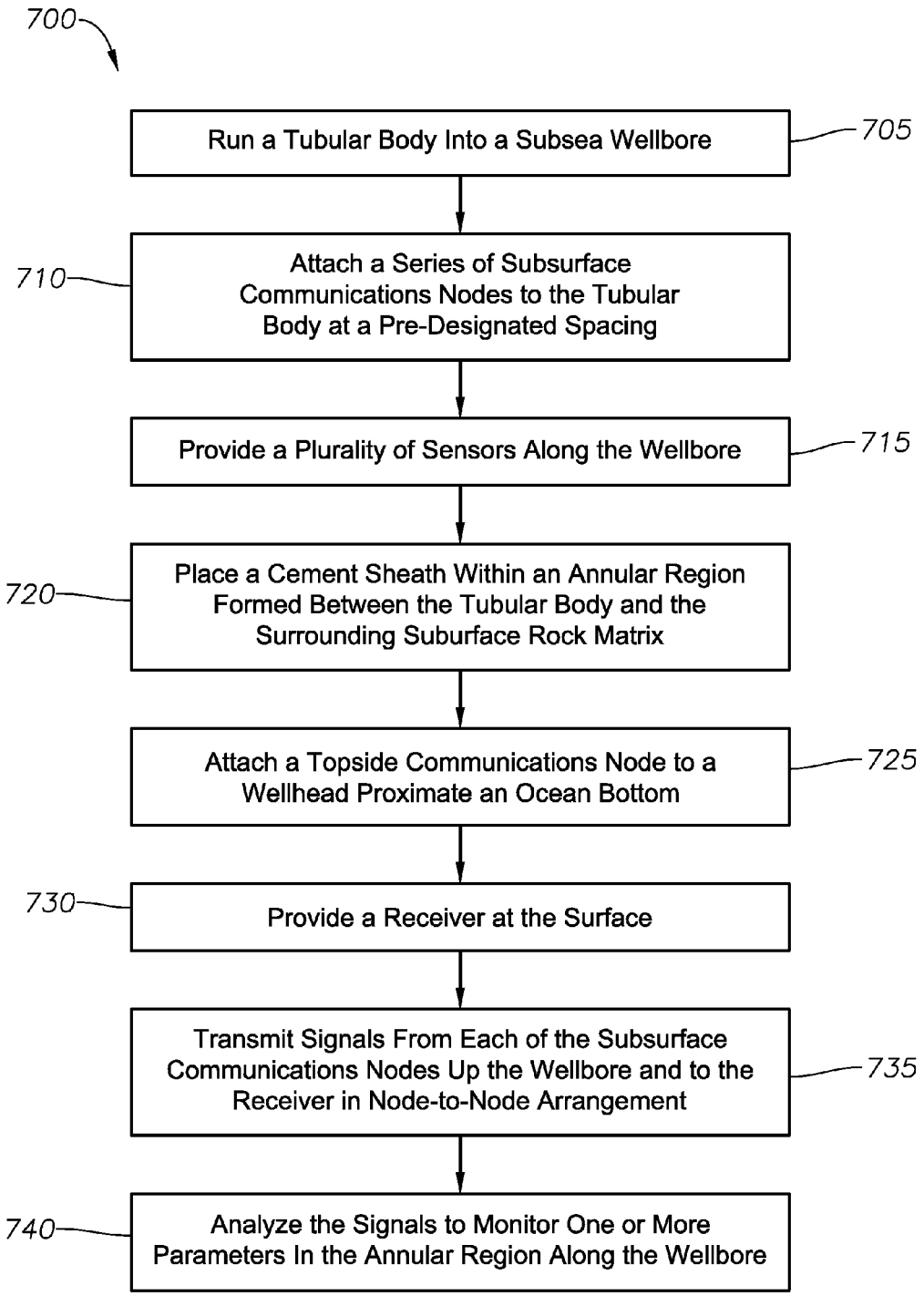
FIGS. 7A and 7B together provide a flowchart demonstrating steps of a method for monitoring a parameter within an annular region along a wellbore in accordance with the present inventions, in one embodiment.
Figure 7B:
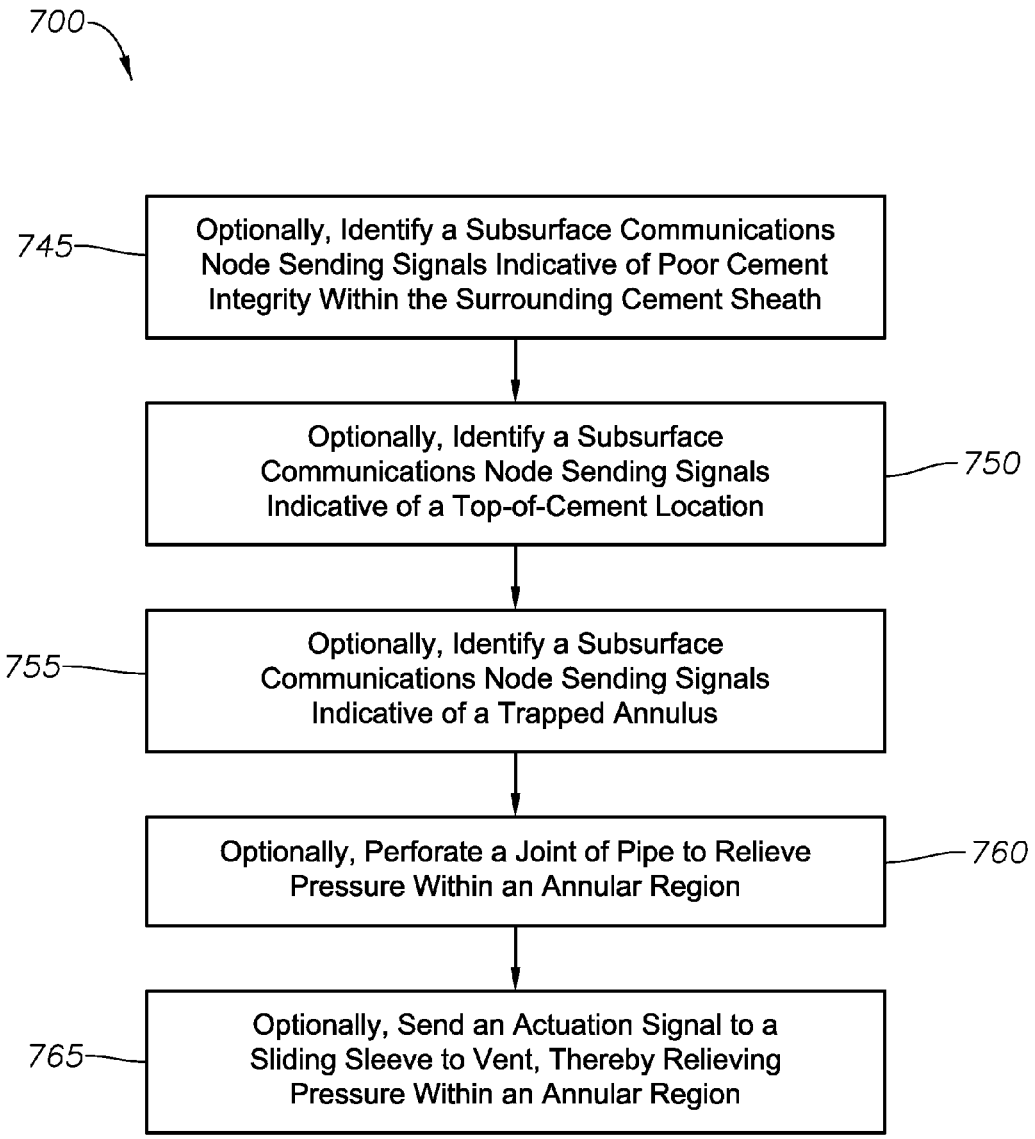

FIGS. 7A and 7B together provide a flow chart for a method 700 of monitoring a condition of an annular region. The method 700 uses a plurality of data transmission nodes situated along a casing string to accomplish a wireless transmission of data along the wellbore. The data represents signals that are suggestive of the monitored condition. The method preferably employs the communications node 400 of FIG. 4A and the communications node system 600 of FIG. 6.

The method 700 first includes running a tubular body into the wellbore. This is shown at Box 705. The tubular body is formed by connecting a series of pipe joints end-to-end. The pipe joints are connected by threaded couplings. The joints of pipe are fabricated from a steel material suitable for conducting an acoustic signal. This means that the joints of pipe, referred to as casing, have a resonance frequency.

In the step of Box 705, the wellbore is preferably a subsea wellbore. The wellbore may be below an ocean, a large lake, or other body of water.

The method 700 also provides for attaching a series of subsurface communications nodes to the joints of pipe. This is provided at Box 710. The communications nodes are attached according to a pre-designated spacing. In one aspect, each joint of pipe receives a communications node. Preferably, each of the subsurface communications nodes is attached to a joint of pipe by one or more clamps. In this instance, the step 710 of attaching the communications nodes to the joints of pipe comprises clamping the communications nodes to an outer surface of the joints of pipe. Alternatively, an adhesive material or welding may be used for the attaching step 710.

The method 700 also comprises providing a plurality of sensors along the wellbore. This is shown at Box 715. Each sensor is configured to sense a parameter within the annular region. In addition, each sensor is in electrical communication with an associated subsurface communications node. In one aspect, the sensors reside within a steel housing of the subsurface communications nodes.

In one embodiment, each of the subsurface communications nodes is a temperature sensor. When the cement job is complete and the cement is setting, an exothermic reaction will take place. Changes in temperature will be indicative of the present of cement between communications nodes. The communications nodes are then designed to generate a signal that corresponds to temperature readings sensed by the respective temperature sensors along their corresponding joints of pipe.

In another embodiment, strain gauges are used as sensors. Strain gauge data can be used to determine changes in stress on the casing as cement transitions from a fluid capable of transmitting hydrostatic pressure to a solid that is set. Strain gauge data can also be used to later identify volumetric changes within the set cement due to chemical reactions as cement hydration continues. Further, strain gauge data may be used to detect a pressure increase in the wellbore due to reservoir fluid influx through a flaw in the cement sheath. Data from the strain gauges may be included as part of the packet of information sent to the receiver at the surface for analysis.

Other sensors may include pressure sensors, acoustic transducers, and microphones. In any instance, each signal sent from an originating subsurface communications node defines a packet of information having (i) an identifier for a subsurface communications node originally transmitting the signal, and (ii) an acoustic amplitude value for the parameter.

The method 700 further includes placing a cement sheath around the tubular body. This is indicated at Box 720. The cement sheath is placed within an annular region formed between the casing joints and the surrounding subsurface rock matrix. The cement sheath is placed in the annular region using any known method of cementing casing into a wellbore. Typically, cement is injected down the casing string behind a wiper plug and ahead of an elastomeric dart, through a cement shoe, and back up the annular region. In the method 700, the cement sheath will ideally surround the externally placed communications nodes in the annular region along areas where a cement sheath is desired.

The method 700 additionally includes attaching a topside communications node to a wellhead. This is seen at Box 725. The topside communications node may be in accordance with node 400 of FIGS. 4A and 4B. The well head resides proximate an ocean bottom. The topside communications node transmits either wired or wireless signals to a receiver at the surface.

The subsurface communications nodes are configured to transmit acoustic waves up to the topside communications node. Each subsurface communications node includes a transceiver that receives an acoustic signal from a previous communications node, and then transmits or relays that acoustic signal to a next communications node, in node-to-node arrangement.

The method 700 also includes providing a receiver. This is shown at Box 730. The receiver is placed at the surface. The receiver has a processor that processes signals received from the topside communications node, such as through the use of firmware and/or software. The receiver preferably receives electrical or optical signals via a so-called "Class I, Division I" conduit or through a radio signal. The processor processes signals to identify which signals correlate to which subsurface communications node. This may involve the use of a multiplexer or a pulse-receive switch.

The method next includes transmitting signals from the communications nodes up the wellbore and to the receiver. This is provided at Box 735. The signals are acoustic signals that have a resonance amplitude. These signals are sent up the wellbore, node-to-node, to the topside communications node. In one aspect, piezo wafers or other piezoelectric elements are used to receive and transmit acoustic signals. In another aspect, multiple stacks of piezoelectric crystals or other magnetostrictive devices are used. Signals are created by applying electrical signals of an appropriate frequency across one or more piezoelectric crystals, causing them to vibrate at a rate corresponding to the frequency of the desired acoustic signal. Each acoustic signal represents a packet of data ideally comprised of a collection of separate tones.

In one aspect, the data transmitted between the nodes is represented by acoustic waves according to a multiple frequency shift keying (MFSK) modulation method. Although MFSK is well-suited for this application, its use as an example is not intended to be limiting. It is known that various alternative forms of digital data modulation are available, for example, frequency shift keying (FSK), multi-frequency signaling (MF), phase shift keying (PSK), pulse position modulation (PPM), and on-off keying (OOK). In one embodiment, every 4 bits of data are represented by selecting one out of sixteen possible tones for broadcast.

Acoustic telemetry along tubulars is characterized by multi-path or reverberation which persists for a period of milliseconds. As a result, a transmitted tone of a few milliseconds duration determines the dominant received frequency for a time period of additional milliseconds. Preferably, the communication nodes determine the transmitted frequency by receiving or "listening to" the acoustic waves for a time period corresponding to the reverberation time, which is typically much longer than the transmission time. The tone duration should be long enough that the frequency spectrum of the tone burst has negligible energy at the frequencies of neighboring tones, and the listening time must be long enough for the multipath to become substantially reduced in amplitude. In one embodiment, the tone duration is 2 ms, then the transmitter remains silent for 48 milliseconds before sending the next tone. The receiver, however, listens for 2+48=50 ms to determine each transmitted frequency, utilizing the long reverberation time to make the frequency determination more certain. Beneficially, the energy required to transmit data is reduced by transmitting for a short period of time and exploiting the multi-path to extend the listening time during which the transmitted frequency may be detected.

In one embodiment, an MFSK modulation is employed where each tone is selected from an alphabet of 16 tones, so that it represents 4 bits of information. With a listening time of 50 ms, for example, the data rate is 80 bits per second.

The tones are selected to be within a frequency band where the signal is detectable above ambient and electronic noise at least two nodes away from the transmitter node so that if one node fails, it can be bypassed by transmitting data directly between its nearest neighbors above and below. In one example the tones are evenly spaced in frequency, but the tones may be spaced within a frequency band from about 50 kHz to 500 kHz. More preferably, the tones are evenly spaced in frequency within a frequency band approximately 25 kHz wide centered around 100 kHz.

Preferably, the nodes employ a "frequency hopping" method where the last transmitted tone is not immediately re-used. This prevents extended reverberation from being mistaken for a second transmitted tone at the same frequency. For example, 17 tones are utilized for representing data in an MFSK modulation scheme; however, the last-used tone is excluded so that only 16 tones are actually available for selection at any time.

The communications nodes will transmit data as mechanical waves at a rate exceeding about 50 bps.

The method 700 also includes analyzing the signals from the communications nodes. This is seen at Box 740. In one embodiment, the signals are analyzed to evaluate the integrity of the cement sheath adjacent or in proximity to each of the subsurface communications nodes. Preferably, the signals are analyzed after the cement has set into a solid material having a compressive strength. Analyzing the signals may mean comparing the amplitude to a baseline or to other amplitude readings.

The receiver (or a processor associated with the receiver) will compare amplitude values of the various acoustic signals, or waveforms, against a baseline amplitude value to confirm that the amplitude is not too high. The baseline amplitude value may be a specific value input into the program representative of an expected amplitude value for a joint of casing having fluids within its bore and a cement sheath around its outer surface. Alternatively, the baseline amplitude value may be a moving average amplitude value determined by the program by averaging amplitude readings from a pre-designated number of communications nodes in proximity to the subject communications node. In one aspect, matrix equations are used to calculate a moving average, which serves as the baseline amplitude value. In any instance, an excessively high amplitude value suggests that cement has not been adequately "squeezed" around the pipe joint at the level of the communications node.

Alternatively, analyzing the signals may mean measuring attenuation of a sonic signal. Propagation of acoustic waves between pairs of electro-acoustic transducers on neighboring subsurface communications nodes produces localized information (between two nodes) about the presence of cement and bonding. The level of acoustic wave attenuation increases from empty casing, to water-filled casing, to mud-filled casing, to casing with cement slurry (before setting), to a solidified/set cement. A plurality of pair-wise acoustic attenuation measurements provides a real-time log of the presence of cement. Optionally, this acoustic attenuation data is correlated with conventional cement bond-log data to analyze cement integrity.

In another aspect, the communications nodes are designed to generate a signal that corresponds to temperature readings taken by the temperature sensors. The electro-acoustic transceivers in the subsurface communications nodes transmit acoustic signals up the wellbore representative of the temperature readings, node-to-node. In this instance, the packet of information generated by each subsurface communications node further has an acoustic waveform indicative of a temperature reading.

Where the waveform signals correspond to temperature readings, the signals are compared to a baseline temperature value representing an expected temperature for fresh cement. Alternatively, the baseline temperature value may be a moving average temperature value determined by the program by averaging temperature readings from a pre-designated number of communications nodes in proximity to the subject communications node. In any instance, if the temperature reading from a specific communications node is too low, that is, below baseline or well below moving average, this will suggest that cement has not been adequately squeezed around the pipe joint at the level of that communications node.

The method 700 will further include the step of identifying a subsurface communications node that is sending signals indicative of poor cement integrity within the surrounding cement sheath. This is provided at Box 745 of FIG. 7B. If signals are received, such as from a temperature sensor or an acoustic reading suggestive of a non-continuous cement sheath, and assuming the cement has not yet set, then the operator may choose to continue squeezing cement into the wellbore, through the cement shoe, and up the annular region.

The method 700 may also optionally include the step of identifying a top-of-cement location. This is provided at Box 750. In this instance, the same temperature readings and acoustic amplitude values may suggest a top-of-cement location behind the casing wall.

In another embodiment, analyzing signals may mean monitoring pressure values, strain gauge values, or a combination thereof. In this instance, the sensors will include pressure sensors and/or strain gauges. The method 700 will then include identifying a subsurface communications node sending signals indicative of a trapped annulus. This step is shown at Box 755.

In connection with the step of Box 755, it is observed that pressure will sometimes build in an annular region once production operations begin. The temperatures of formation fluids are usually higher than those further uphole. As formation fluids travel toward the well head, they heat the pipe strings and the surrounding annuli. This, in turn, will raise the temperature of fluids inside the annuli between the pipe strings, and the fluids will tend to expand. Accordingly, it is advantageous to monitor pressure and strain gauge readings when the well is placed on line.

Where the well resides on land, the fluid expansion may be relieved at the surface. However, in offshore-well situations in which the well head is submerged, both the top and bottom of each annulus may be sealed to prevent the fluids contained therein from leaking into the marine environment. This means that there is no outlet for annular fluid expansion. When the formation fluids heat the fluid trapped in the annulus between the casing strings, the resulting expansion may pressurize the annulus to a level that would cause severe wellbore damage, including damage to the cement sheath, the casing, tubulars and other wellbore equipment. This process is known in the art as annular pressure buildup (APB), or a trapped annulus.

To monitor for this scenario, a processor is provided that receives signals that are indicative of the pressure value readings and/or strain gauge value readings downhole. These signals may be received by the receiver at the surface, where they are analyzed by an operator or by an algorithm running on a processor associated with the receiver. Strain gauge data can be used to determine changes in stress on the casing as cement transitions from a fluid capable of transmitting hydrostatic pressure to a solid that is set. Strain gauge data can also be used to later identify volumetric changes within the set cement due to chemical reactions as cement hydration continues. Further, strain gauge data may be used to detect a pressure increase in the wellbore due to reservoir fluid influx through a flaw in the cement sheath. Data from the strain gauges may be included as part of the packet of information sent to the receiver at the surface for analysis.

Pressure readings are the strongest indication of a trapped annulus. Direct pressure readings may be compared with a known collapse pressure or hoop rating for the casing being used.

If the strain and/or pressure signals indicate the presence of a trapped annulus, then the operator may institute an operation to perforate the casing. Perforating the casing creates a vent, or pressure release, thereby relieving the condition of excess pressure behind the casing. This step is seen at Box 760. Preferably, the perforating step is conducted along an upper end of the casing string under study.

Alternatively, an actuation signal is sent by the operator to a sliding sleeve. This step is provided at Box 765 of FIG. 7B. The sleeve resides along the casing, preferably proximate a top of the casing string. The actuation signal causes the sleeve to open.

In one aspect, the pressure and/or strain gauge signals are received directly by a processor on a sliding sleeve downhole. The processor compares the pressure and/or strain gauge readings with a reference table, a baseline value, or with a provided data set, to determine whether a condition of a trapped annulus is likely. If the combination of pressure and strain gauge readings suggests that a condition of a trapped annulus exists, then the vent may automatically open. The opening preferably occurs for a short time, such as five minutes.

In one aspect, a perforating device may be provided along the casing in lieu of a sliding sleeve. In this instance, the pressure and/or strain gauge signals are received directly by a processor on the perforating device. The processor compares the pressure and/or strain gauge readings with a reference table, or with a provided data set, to determine whether a condition of a trapped annulus is likely. If the combination of pressure and strain gauge readings suggests that a condition of a trapped annulus exists, then the perforating gun is actuated automatically.

In another embodiment, microphones are placed within selected subsurface communications nodes. Passive acoustic data gathered by microphones can be used to detect wellbore fluids, especially gas, that are flowing through a flaw or "mud streak" in the cement sheath. As gas moves through a small gap it will produce ambient noises across a broad range of frequencies that can be detected by passive acoustic sensors in the nodes. Data from microphones may be included as part of the packet of information sent to the receiver at the surface for analysis, and can be used to detect the presence of gaps in a cement sheath.

As can be seen, various data can be gathered by sensors including temperature measurements, casing strain, noise caused by gas flow, pressure measurements, and acoustic wave measurements themselves. All of this data may be considered together in evaluating a cement sheath or other condition in an annular region along a wellbore.

In the method 700, each of the communications nodes has an independent power source. The independent power source may be, for example, batteries or a fuel cell. Having a power source that resided within the housing of the communications nodes avoids the need for passing electrical connections through the housing, which could compromise fluid isolation. In addition, each of the intermediate communications nodes has a transducer and associated transceiver.

Preferably, the electro-acoustic transducer receives acoustic signals at a first frequency, and then sends acoustic signals at a second frequency that is different from the first frequency. Each transducer then "listens" for signals at the second frequency. Preferably, each transducer "listens" for the acoustic waves sent at the first frequency until after reverberation of the acoustic waves at the first frequency has substantially attenuated. Thus, a time is selected for both transmitting and for receiving. In one aspect, the listening time may be about twice the time at which the waves at the first frequency are transmitted or pulsed. To accomplish this, the transducer will operate with and under the control of a micro-processor located on a printed circuit board, along with memory. Beneficially, the energy required to transmit signals is reduced by transmitting for a shorter period of time.

As can be seen, a novel downhole telemetry system is provided, as well as a novel method for the wireless transmission of information using a plurality of data transmission nodes for detecting cement sheath integrity. In some states, new fracking regulations are being implemented which requires the use of cement bond logs. However, the system disclosed herein may be used by an operator in lieu a cement bond log, or in addition to a cement bond log.

While it will be apparent that the inventions herein described are well calculated to achieve the benefits and advantages set forth above, it will be appreciated that the inventions are susceptible to modification, variation and change without departing from the spirit thereof.

What is claimed is:

1. An acoustic telemetry system for monitoring a parameter along an annular region in a cased-hole wellbore, comprising:

a casing string disposed in the wellbore, with a cement sheath residing at least partially within the annular region formed between the casing string and a surrounding subsurface rock matrix along the casing string;

a topside communications node placed proximate a well head of the wellbore;

a plurality of subsurface communications nodes spaced along the wellbore and attached to a wall of the casing string, the subsurface communications nodes configured to transmit acoustic signals from node-to-node up the wellbore and to the topside communications node;

one or more sensors for sensing the parameter within the annular region, with each sensor being in electrical communication with an associated subsurface communications node; and a receiver at the surface configured to receive at least one of electrical signals and acoustic signals from the topside communications node;

a processor in communication with the receiver for analyzing the received at least one of the electrical signals and the acoustic signals received at the receiver, the processor evaluating the integrity of the cement sheath by comparing attenuation of the received acoustic signals between pairs of subsurface communications nodes; and wherein each of the subsurface communications nodes comprises:

a sealed housing;

an electro-acoustic transducer and associated transceiver also residing within the housing, with the transceiver being designed to relay the acoustic signals from node-to-node up the wellbore, with each acoustic signal including a packet of information that comprises an identifier for the subsurface communications node that originally transmitted the acoustic signal from node-to-node, and an acoustic waveform having an amplitude indicative of the parameter; and an independent power source residing within the housing providing power to the transceiver.

2. The electro-acoustic telemetry system of claim 1, wherein:

the wellbore is a subsea wellbore;

the well head is located on a bottom of a body of water; and the topside communications node is configured to transmit signals to the receiver.

3. The electro-acoustic telemetry system of claim 2, wherein the body of water is an ocean, a sea, a bay or a lake.

4. The electro-acoustic telemetry system of claim 2, wherein the topside communications node is in electrical communication with a cable for transmitting the electrical signals from the topside communications node to the receiver.

5. The electro-acoustic telemetry system of claim 2, wherein:

the topside communications node comprises a transceiver for transmitting wireless acoustic signals to the receiver; and each packet of information comprises a plurality of separate tones.

6. The electro-acoustic telemetry system of claim 2, wherein:

the parameter is pressure; and each of the sensors comprises a pressure sensor.

7. The electro-acoustic telemetry system of claim 2, further comprising:

a sliding sleeve along the casing string, the sliding sleeve being configured to open in response to a signal, thereby relieving annular pressure.

8. The electro-acoustic telemetry system of claim 7, wherein:

the signal to open the sliding sleeve is an actuation signal originating from the surface;

the sliding sleeve is located proximate an upper end of the casing string; and the sliding sleeve is configured to receive an acoustic signal transmitted from the topside communications node, and through the subsurface communications nodes, node-to-node, to the sliding sleeve.

9. The electro-acoustic telemetry system of claim 7, wherein:

the signal to open the sliding sleeve is an acoustic signal originating in the wellbore; and the sliding sleeve comprises an electro-acoustic transducer for converting the acoustic signal originating in the wellbore to an electrical signal for the sliding sleeve, and a processor for sending the electrical signal for the sliding sleeve as an actuation signal to open the sleeve.

10. The electro-acoustic telemetry system of claim 7, wherein the:

the sliding sleeve is associated with a pressure sensor; and the signal to open the sliding sleeve is an electrical actuation signal received from the associated sensor that causes the sliding sleeve to open automatically.

11. The electro-acoustic telemetry system of claim 2, wherein:

the parameter is casing strain;

one or more of the sensors comprises a strain gauge; and the electro-acoustic transceivers transmit signals up the wellbore representative of strain readings, node-to-node, as part of the packets of information.

12. The electro-acoustic telemetry system of claim 2, wherein:

the system further comprises a sliding sleeve proximate an upper end of the casing string, the sliding sleeve being configured to open in response to a signal, thereby relieving annular pressure;

the sliding sleeve is associated with a strain gauge; and the signal to open the sliding sleeve is an electrical actuation signal received from the associated strain gauge that causes the sliding sleeve to open.

13. The electro-acoustic telemetry system of claim 12, wherein the sliding sleeve comprises a processor that compares a value of signals indicative of strain gauge with a baseline value, and sends the actuation signal if the value of the signal indicative of strain gauge exceeds the baseline value, causing the sliding sleeve to open automatically.

14. The electro-acoustic telemetry system of claim 2, wherein:

the parameter is the presence of cement in the annular region; and each of the sensors comprises the electro-acoustic transducer and associated transceiver for sending and receiving the acoustic signals from node-to-node.

15. The electro-acoustic telemetry system of claim 14, wherein:

each of the packets of information comprises a plurality of separate tones;

the receiver comprises a processor; and the processor at the receiver is programmed to identify amplitude values of the tones generated by each subsurface communications node indicative of the parameter, and compare those amplitude values to a baseline amplitude value.

16. The electro-acoustic telemetry system of claim 15, wherein the baseline amplitude value is (i) a previously stored amplitude value indicative of an amplitude value of a joint of casing having a continuous annular cement sheath, or (ii) a moving average of amplitude readings taken from a pre-designated number of communications nodes in proximity to a subject communications node.

17. The electro-acoustic telemetry system of claim 1, wherein the system is used in a wellbore associated with the production of hydrocarbons.

18. The electro-acoustic telemetry system of claim 1, wherein the subsurface communications nodes are spaced at 20 to 40 foot (6.1 to 12.2 meter) intervals.

19. The electro-acoustic telemetry system of claim 1, wherein the subsurface communications nodes transmit data in acoustic form at a rate exceeding 50 bps.

20. The electro-acoustic telemetry system of claim 1, wherein each of the electro-acoustic transceivers is designed to listen for tones that are selected to be within a frequency band where the acoustic signals from node to node are detectable at least two nodes away from a transmitting communications node.

21. The electro-acoustic telemetry system of claim 20, wherein:

each subsurface communications node is configured to listen for acoustic signals generated for a longer time than the time for which acoustic signals were generated by a previous subsurface communications node;

acoustic signals provide data that is modulated by a multiple frequency shift keying method where each tone is selected from an alphabet of at least 8 tones.

22. The electro-acoustic system of claim 2, wherein:

each of the sensors resides within the housings of a selected subsurface communications node; and the electro-acoustic transducers within the selected subsurface communications nodes convert electrical signals from the sensors into acoustic signals for the associated transceivers.

23. The electro-acoustic telemetry system of claim 22, wherein acoustic signals provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

24. The electro-acoustic telemetry system of claim 1, wherein the subsurface communications nodes are attached to an outer wall of the casing string by (i) an adhesive material, (ii) welding, or (iii) one or more mechanical fasteners.

25. The electro-acoustic telemetry system of claim 1, wherein:

each of the subsurface communications nodes is attached to the casing string by one or more clamps; and each of the one or more clamps comprises:

a first arcuate section;

a second arcuate section;

a hinge for pivotally connecting the first and second arcuate sections; and a fastening mechanism for securing the first and second arcuate sections around an outer surface of the casing string.

26. A method of monitoring a parameter along an annular region in a cased-hole, subsea wellbore, the wellbore having a wellhead placed proximate a bottom of a body of water, and the method comprising:

running joints of casing into the wellbore, the joints of casing being connected by threaded couplings to form a casing string;

attaching a series of subsurface communications nodes to the joints of casing according to a pre-designated spacing, wherein adjacent subsurface communications nodes communicate by acoustic signals transmitted through the joints of casing;

providing one or more sensors along the wellbore, each sensor being configured to sense the parameter within the annular region, and each sensor being in electrical communication with an associated subsurface communications node using electrical signals;

placing a cement sheath within the annular region formed between the casing string and a surrounding subsurface matrix at least partially along the casing string;

attaching a topside communications node to the wellhead, wherein the topside communications node comprises an electro-acoustic transducer for receiving the acoustic signals from the subsurface communications nodes:

sending acoustic signals from the one or more sensors to a receiver at the surface via the series of subsurface communications nodes and the topside communications node, with each acoustic signal including a packet of information that comprises an identifier for the subsurface communications node that originally transmitted the acoustic signal transmitted through the joints of casing, and an acoustic waveform having an amplitude indicative of the parameter;

analyzing at least one of the electrical signals and the acoustic signals from adjacent pairs of the subsurface communications nodes to monitor the parameter; and evaluating the integrity of the cement sheath, wherein evaluating the integrity of the cement sheath comprises measuring attenuation of the acoustic signals between pairs of subsurface communications nodes.

27. The method of claim 26, wherein the body of water is an ocean, a sea, a bay or a lake.

28. The method of claim 27, wherein each of the subsurface communications nodes comprises:

a sealed housing;

an electro-acoustic transducer and associated transceiver residing within the housing configured to relay acoustic signals, with each acoustic signal including a packet of information that comprises an identifier for the subsurface communications node originally transmitting the signal, and an acoustic waveform; and an independent power source also residing within the housing for providing power to the transceiver.

29. The method of claim 28, wherein the housing for each of the subsurface communications nodes is fabricated from a steel material, with the steel material of the housing having a resonance frequency compatible within a bandwidth of a resonance frequency of the acoustic waveforms transmitted through the joints of casing.

30. The method of claim 26, wherein:

the parameter is acoustic values of the waveforms; and the step of analyzing the acoustic signals further comprises:

identifying amplitude values generated by each of the subsurface communications nodes; and comparing those amplitude values to a baseline amplitude value.

31. The method of claim 26, further comprising producing hydrocarbons through the wellbore.

32. The method of claim 30, further comprising:

identifying a subsurface communications node sending acoustic signals indicative of poor cement integrity within the surrounding cement sheath.

33. The method of claim 32, further comprising:

perforating the joint of casing supporting the subsurface communications node sending the acoustic signals indicative of poor cement integrity within the surrounding cement sheath; and squeezing cement through the perforated joint of casing and into the annular region around the casing string.

34. The method of claim 32, wherein evaluating the integrity of the cement sheath further comprises comparing the attenuation of the acoustic signals with cement bond-log data.

35. The method of claim 26, wherein:

the parameter is pressure;

each of the sensors comprises a pressure sensor; and the step of analyzing the acoustic signals comprises reviewing pressure data generated by the pressure sensors.

36. The method of claim 35, further comprising:

determining that a condition of excess pressure exists within the annular region; and sending an actuation signal from the surface, through the topside communications node, and through the subsurface communications nodes, node-to-node, to a sliding sleeve to open the sliding sleeve, thereby relieving annular pressure behind the casing string.

37. The method of claim 26, wherein:

the parameter is casing strain;

one or more of the sensors comprises a strain gauge;

electro-acoustic transceivers transmit acoustic signals up the wellbore representative of strain readings from the strain gauge, node-to-node, as part of the packets of information; and the step of analyzing the acoustic signals comprises reviewing strain data generated by the strain gauges.

38. The method of claim 26, wherein:

the parameter is temperature;

one or more of the sensors comprises a temperature sensor; and electro-acoustic transceivers transmit acoustic signals up the wellbore representative of temperature readings from the temperature sensor, node-to-node, as part of the packets of information.

39. The method of claim 38, wherein the step of analyzing the acoustic signals further comprises:

identifying temperature values generated by the sensors to determine the presence or absence of cement in the annular region through monitoring a heat-of-hydration of the cement as it sets.

40. The method of claim 26, further comprising:

determining that a condition of excess pressure exists within the annular region; and perforating the casing string in order to relieve annular pressure behind the casing string.

41. The method of claim 26, further comprising:

providing a sliding sleeve along the casing string, wherein the sliding sleeve is configured to open in response to an actuation signal, thereby relieving annular pressure behind the casing string.

42. The method of claim 41, wherein:

the sliding sleeve comprises a strain gauge or a pressure sensor; and the actuation signal is an electrical actuation signal received from the associated strain gauge or pressure sensor that causes the sliding sleeve to open where a strain gauge reading, a pressure reading, or both, are indicative of a trapped annulus.

43. The electro-acoustic telemetry system of claim 42, wherein:

the sliding sleeve comprises a processor that compares strain gauge and pressure data with pre-determined baseline values, and sends the actuation signal if the value of the strain gauge data, the pressure data, or both exceeds the pre-determined baseline values, causing the sliding sleeve to open automatically; and the step of analyzing the at least one of the electrical signals and the acoustic signals is conducted by the processor in the sliding sleeve.

44. The method of claim 26, wherein a frequency band for the acoustic wave transmission by the transceivers is 25 KHz wide.

45. The method of claim 26, wherein a frequency band for the acoustic wave transmission by the transceivers operates from 50 kHz to 500 kHz.

46. The method of claim 26, wherein acoustic signals provide data that is modulated by (i) a multiple frequency shift keying method, (ii) a frequency shift keying method, (iii) a multi-frequency signaling method, (iv) a phase shift keying method, (v) a pulse position modulation method, or (vi) an on-off keying method.

* * * * *